US011552457B2

(12) United States Patent
Ishigami et al.

(10) Patent No.: US 11,552,457 B2
(45) Date of Patent: Jan. 10, 2023

(54) DISCHARGE DEVICE AND METHOD FOR MANUFACTURING SAME

(71) Applicant: PANASONIC INTELLECTUAL PROPERTY MANAGEMENT CO., LTD., Osaka (JP)

(72) Inventors: Youhei Ishigami, Shiga (JP); Masaharu Machi, Kyoto (JP); Takafumi Omori, Shiga (JP); Tomohiro Yamaguchi, Shiga (JP); Osamu Imahori, Shiga (JP); Tetsunori Aono, Hyogo (JP); Takayuki Nakada, Shiga (JP); Yukari Nakano, Shiga (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 302 days.

(21) Appl. No.: 15/656,900

(22) Filed: Jul. 21, 2017

(65) Prior Publication Data

US 2018/0034248 A1 Feb. 1, 2018

(30) Foreign Application Priority Data

Aug. 1, 2016 (JP) ..... JP2016-151593

(51) Int. Cl.
*H01T 19/04* (2006.01)
*H01T 21/00* (2006.01)
(Continued)

(52) U.S. Cl.
CPC ..... *H01T 19/04* (2013.01); *B05B 5/0255* (2013.01); *B05B 5/057* (2013.01); *H01T 21/00* (2013.01); *H01T 23/00* (2013.01)

(58) Field of Classification Search
CPC ..... B05B 5/0255; B05B 5/057; H01T 19/00; H01T 19/02; H01T 19/04; H01T 21/00; H01T 23/00; B01J 9/088
See application file for complete search history.

(56) References Cited

U.S. PATENT DOCUMENTS 3,355,930 A * 12/1967 Fedorov ..... B21K 1/30 72/377
3,973,933 A 8/1976 Masuda
(Continued)

FOREIGN PATENT DOCUMENTS

CN 101801537 A 8/2010
CN 103781555 A 5/2014
(Continued)

OTHER PUBLICATIONS

Electrical Breakdown. In Wikipedia. Retrieved Aug. 27, 2020, from https://en.wikipedia.org/wiki/Electrical_breakdown.*
(Continued)

*Primary Examiner* — Tuongminh N Pham
(74) *Attorney, Agent, or Firm* — McDermott Will & Emery LLP

(57) ABSTRACT

A discharge device according to the present disclosure includes a discharge electrode and a voltage applicator that applies a voltage to the discharge electrode and thus causes discharge that is further developed from corona discharge at the discharge electrode. The discharge is discharge in which a discharge path is intermittently formed by dielectric breakdown so as to stretch from the discharge electrode to a surrounding. This discharge can be called leader discharge. This makes it possible to increase an amount of generated active component while keeping an increase of ozone small.

21 Claims, 20 Drawing Sheets

(51) Int. Cl.

| | |
|---|---|
| ***B05B 5/057*** | (2006.01) |
| ***H01T 23/00*** | (2006.01) |
| ***B05B 5/025*** | (2006.01) |

(56) References Cited

U.S. PATENT DOCUMENTS

| | | | | |
|---|---|---|---|---|
| 2007/0119993 | A1* | 5/2007 | Yamaguchi | B05B 5/057 239/704 |
| 2012/0007134 | A1* | 1/2012 | Miyai | H01L 27/329 257/99 |
| 2012/0126041 | A1 | 5/2012 | Nunomura et al. | |
| 2012/0224293 | A1* | 9/2012 | Partridge | H01T 23/00 361/230 |
| 2014/0209710 | A1 | 7/2014 | Komura et al. | |
| 2015/0179411 | A1* | 6/2015 | Laux | H01J 37/32568 423/659 |
| 2016/0031708 | A1* | 2/2016 | Machi | H01T 23/00 422/186.2 |
| 2017/0128906 | A1* | 5/2017 | Louis | A61L 9/22 |
| 2019/0111405 | A1* | 4/2019 | Katano | C01B 13/11 |

FOREIGN PATENT DOCUMENTS

| | | | | |
|---|---|---|---|---|
| EP | 1544969 | A1 | 6/2005 | |
| EP | 2974749 | A1 | 1/2016 | |
| JP | 50-052675 | A | 5/1975 | |
| JP | 54-093272 | A | 7/1979 | |
| JP | 2003-017297 | A | 1/2003 | |
| JP | 2004-055351 | A | 2/2004 | |
| JP | 2004-349145 | A | 12/2004 | |
| JP | 2008-181697 | A | 8/2008 | |
| JP | 2011-031184 | A | 2/2011 | |
| JP | 2011-067738 | A | 4/2011 | |
| JP | 2012-005153 | A | 1/2012 | |
| JP | 2014-108120 | A | 6/2014 | |
| JP | 2015-141735 | A | 8/2015 | |
| WO | WO-2014141604 | A1 * | 9/2014 | H01T 23/00 |

OTHER PUBLICATIONS

English Translation of Chinese Search Report dated Nov. 7, 2019 for the related Chinese Patent Application No. 201710613721.3.

The Extended European Search Report dated Dec. 15, 2017 for the related European Patent Application No. 17182474.1.

International Search Report of PCT application No. PCT/JP2017/026622 dated Sep. 26, 2017.

Singapore Written Opinion dated Jan. 15, 2020 for the related Singapore Patent Application No. 11201811571W.

Communication pursuant to Article 94(3) EPC dated Mar. 10, 2020 for the related European Patent Application No. 17182474.1.

Hajime Tomita, "Differentiation between Currents Flowing in Earth Wire caused by Coronas and Spark Discharges (Partial English Translation)", Journal of Occupational Safety and Health, vol. 4, No. 2, pp. 79-83, (2011), filed in response to the Chinese Office Action for the corresponding Chinese patent application dated Nov. 7, 2019.

Communication pursuant to Article 94(3) EPC dated Oct. 21, 2020 for the related European Patent Application No. 17182474.1.

English Translation of Chinese Search Report dated Oct. 26, 2021 for the related Chinese Patent Application No. 202110183250.3.

Yu, Bing, et al. "Research on the Plasma Anemometer Based on AC Glow Discharge," Research Article, Hindawi, Journal of Sensors, vol. 2017; Feb. 28, 2017; 12 pages.

English Translation of Taiwan Search Report dated Dec. 15, 2021 for the related Taiwan Patent Application No. 110116717.

* cited by examiner

DISCHARGE DEVICE AND METHOD FOR MANUFACTURING SAME

RELATED APPLICATIONS

This application claims the benefit of Japanese Application No. 2016-151593, filed on Aug. 1, 2016, the entire disclosure of which Application is incorporated by reference herein.

BACKGROUND

1. Technical Field

The present disclosure relates to a discharge device and a method for manufacturing the same. More specifically, the present disclosure relates to a discharge device that includes a discharge electrode and a voltage applicator that applies a voltage to the discharge electrode and a method for manufacturing the same.

2. Description of the Related Art

Conventionally, a discharge device that includes a discharge electrode and a voltage applicator is provided. As a discharge device, a device that generates air ions by causing a voltage applicator to apply a voltage to a discharge electrode and causing corona discharged at the discharge electrode is known. Furthermore, a device that generates a charged microparticle liquid containing radicals by causing corona discharge at a discharge electrode to which a liquid has been supplied is known as described in Unexamined Japanese Patent Publication No. 2011-67738.

Regarding a discharge device, there are demands for an increase in generated amount of air ions, radicals, and charged microparticle liquid containing air ions or radicals (air ions, radicals, and a charged microparticle liquid are hereinafter collectively referred to as an "active component") by an increase of input energy and demands for suppression of occurrence of ozone. It is, however, difficult for the conventional discharge devices to meet both of these two demands.

SUMMARY

An object of the present disclosure is to provide a discharge device that makes it possible to increase a generated amount of active component while keeping an increase of ozone small and provide a method for manufacturing the discharge device.

In order to solve the problem, a discharge device of the present disclosure includes a discharge electrode and a voltage applicator that applies a voltage to the discharge electrode and thus causes discharge that is further developed from corona discharge at the discharge electrode. The discharge is discharge in which a discharge path is intermittently formed by dielectric breakdown so as to stretch from the discharge electrode to a surrounding.

By thus causing discharge of high energy, a generated amount of active component can be made to be larger than a generated amount of active component in a case of corona discharge, and an increase of ozone can be kept small.

The discharge device of the present disclosure produces an effect that a generated amount of active component can be increased and at this time an increase of ozone can be kept small.

DETAILED DESCRIPTION

Figure 1:
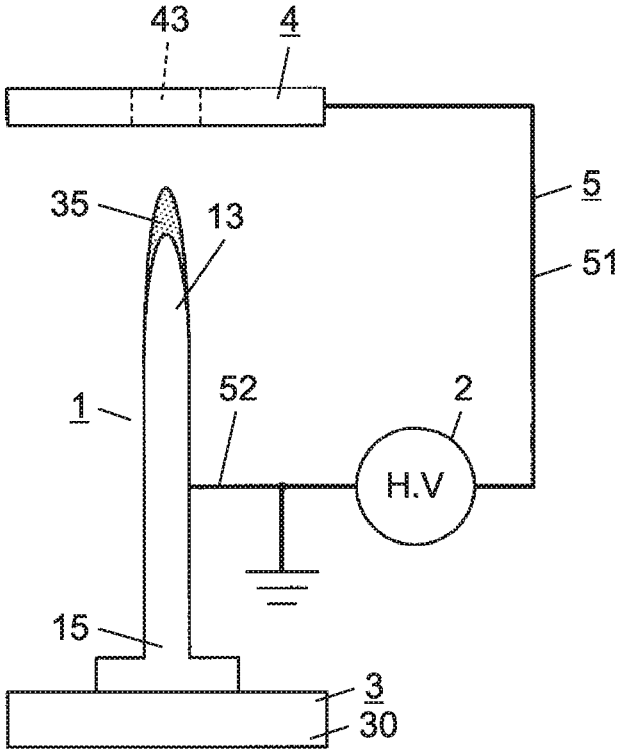
FIG. 1 is a schematic view illustrating a discharge device according to a first exemplary embodiment.

A first aspect of the present disclosure provides a discharge device including a discharge electrode and a voltage applicator that applies a voltage to the discharge electrode and thus causes discharge that is further developed from corona discharge at the discharge electrode. The discharge is discharge in which a discharge path is intermittently formed by dielectric breakdown so as to stretch from the discharge electrode to a surrounding. This makes it possible to increase an amount of generated active component while keeping an increase of ozone small.

A second aspect of the present disclosure provides the discharge device according to the first aspect of the present disclosure, further including a liquid supplying unit that supplies a liquid to the discharge electrode. The liquid supplied to the discharge electrode is electrostatically atomized by the discharge. This makes it possible to increase an amount of generated charged microp article liquid while keeping an increase of ozone small.

A third aspect of the present disclosure provides the discharge device according to the first or second aspect of the present disclosure, further including a counter electrode that is located so as to face the discharge electrode. The discharge is discharge in which a discharge path is intermittently formed by dielectric breakdown so as to connect the discharge electrode and the counter electrode. This allows discharge in which a discharge path is intermittently formed by dielectric breakdown to stably occur between the discharge electrode and the counter electrode.

A fourth aspect of the present disclosure provides the discharge device according to the third aspect of the present disclosure, in which the counter electrode includes a needle-shaped electrode portion that faces the discharge electrode. This allows discharge in which a discharge path is intermittently formed by dielectric breakdown to stably occur between the discharge electrode and the needle-shaped electrode portion.

A fifth aspect of the present disclosure provides the discharge device according to the fourth aspect of the present disclosure, in which the needle-shaped electrode portion has a front-end portion and a base-end portion on opposite sides, respectively; the discharge electrode has an axial direction; and a distance between the front-end portion and the discharge electrode in the axial direction is smaller than a distance between the base-end portion and the discharge electrode in the axial direction. This allows discharge in which a discharge path is intermittently formed by dielectric breakdown to stably occur between the discharge electrode and the needle-shaped electrode portion.

A sixth aspect of the present disclosure provides the discharge device according to the fifth aspect of the present disclosure, in which the counter electrode further includes a supporting electrode portion that is held in a posture orthogonal to the axial direction and a step portion interposed between the supporting electrode portion and the needle-shaped electrode portion. The distance between the base-end portion and the discharge electrode in the axial direction is larger than a distance between the supporting electrode portion and the discharge electrode in the axial direction. This makes it possible to keep protrusion of the front-end portion of the needle-shaped electrode portion small, thereby keeping deformation of the needle-shaped electrode portion small.

A seventh aspect of the present disclosure provides the discharge device according to any one of the fourth to sixth aspects of the present disclosure, in which the needle-shaped electrode portion has a groove for keeping deformation of the needle-shaped electrode portion small; and the groove is formed by bending part of the needle-shaped electrode portion in a thickness direction of the needle-shaped electrode portion. This makes it possible to increase a second moment of area of the needle-shaped electrode portion, thereby keeping deformation of the needle-shaped electrode portion small.

An eighth aspect of the present disclosure provides the discharge device according to the fourth aspect of the present disclosure, in which the counter electrode further includes a supporting electrode portion that supports the needle-shaped electrode portion; and the needle-shaped electrode portion and the supporting electrode portion are made of different materials. This makes it possible to increase resistance of the needle-shaped electrode portion to leader discharge while keeping an increase in cost small.

A ninth aspect of the present disclosure provides the discharge device according to any one of the fourth to eighth aspects of the present disclosure, in which the counter electrode includes a plurality of the needle-shaped electrode portions. This makes it possible to efficiently discharge a generated active component to an outside.

A tenth aspect of the present disclosure provides the discharge device according to the ninth aspect of the present disclosure, in which front-end portions of the respective plurality of the needle-shaped electrode portions are located on an identical circle. This makes it possible to efficiently discharge a generated active component to an outside.

An eleventh aspect of the present disclosure provides the discharge device according to the tenth aspect of the present disclosure, in which the front-end portions of the respective plurality of the needle-shaped electrode portions are located at regular intervals in a circumferential direction of the circle. This makes it possible to efficiently discharge a generated active component to an outside.

A twelfth aspect of the present disclosure provides the discharge device according to any one of the ninth to eleventh aspects of the present disclosure, in which each of the needle-shaped electrode portions has a front-end portion that is rounded. This prevents a large variation in strength of electric field concentration from occurring due to a manufacturing variation of the plurality of the needle-shaped electrode portions.

A thirteenth aspect of the present disclosure provides the discharge device according to any one of the ninth to twelfth aspects of the present disclosure, in which each of the needle-shaped electrode portions is a strip-shaped electrode portion that has a thickness; and of end edges, in a thickness direction, of each of the needle-shaped electrode portions, one end edge closer to the discharge electrode is chamfered. This prevents a large variation in strength of electric field concentration from occurring due to a manufacturing variation of the plurality of the needle-shaped electrode portions.

A fourteenth aspect of the present disclosure provides the discharge device according to any one of the ninth to thirteenth aspects of the present disclosure, in which the plurality of the needle-shaped electrode portions are three or more needle-shaped electrode portions that are located away from one another. This makes it possible to efficiently discharge a generated active component to an outside.

A fifteenth aspect of the present disclosure provides the discharge device according to the fourteenth aspect of the present disclosure, in which the counter electrode further includes an opening in which the three or more needle-shaped electrode portions are disposed; and an opening area of the opening is larger than a total area of the three or more needle-shaped electrode portions. This makes development from corona discharge to leader discharge easy.

A sixteenth aspect of the present disclosure provides the discharge device according to the third aspect of the present disclosure, in which the counter electrode includes at least one sharply-pointed surface that faces the discharge electrode and an opposing surface that faces the discharge electrode; and the opposing surface has a flat surface shape, a concave surface shape, or a shape combining the flat surface shape and the concave surface shape. This allows electric field concentration to easily occur at the front-end portion of the discharge electrode.

A seventeenth aspect of the present disclosure provides the discharge device according to any one of the first to sixteenth aspects of the present disclosure, further including a capacitor that is electrically connected in parallel with the voltage applicator. This makes it possible to adjust a discharge frequency of leader discharge.

An eighteenth aspect of the present disclosure provides a method for manufacturing the discharge device according to the thirteenth aspect of the present disclosure, including crushing the end edges, in the thickness direction, of the plurality of the needle-shaped electrode portions all at once to chamfer the end edges. This makes it possible to make positions of the front-end portions of the plurality of the needle-shaped electrode portions uniform all at once.

Embodiments of the present disclosure will be described below with reference to the drawings. The present disclosure is not limited to the embodiments below, and configurations in the embodiments below may be combined as appropriate.

First Exemplary Embodiment

FIG. 1 illustrates a basic configuration of a discharge device according to the first exemplary embodiment. The discharge device according to the present exemplary embodiment includes discharge electrode 1, voltage applicator 2, liquid supplying unit 3, counter electrode 4, and current path 5.

Discharge electrode 1 is a long thin electrode having a needle shape. Discharge electrode 1 has front-end portion 13 at one end, in an axial direction, of discharge electrode 1 and has base-end portion 15 at the other end, in the axial direction, of the discharge electrode 1 (on a side opposite to front-end portion 13). The term "needle shape" as used herein encompasses not only a case where a front end is sharply pointed, but also a case where a front end is rounded.

Voltage applicator 2 is electrically connected to discharge electrode 1 so that a high voltage of approximately 7.0 kV is applied to discharge electrode 1. The discharge device according to the present exemplary embodiment includes counter electrode 4, and is configured so that voltage applicator 2 applies a high voltage across discharge electrode 1 and counter electrode 4.

Liquid supplying unit 3 is a unit that supplies liquid 35 for electrostatic atomization to discharge electrode 1. In the discharge device according to the present exemplary embodiment, liquid supplying unit 3 is realized by cooler 30 that generates dew condensation water by cooling discharge electrode 1. Cooler 30 is in contact with base-end portion 15 of discharge electrode 1 and cools whole discharge electrode 1 through base-end portion 15. Liquid 35 supplied to discharge electrode 1 by liquid supplying unit 3 is dew condensation water generated on discharge electrode 1.

Counter electrode 4 is located so as to face front-end portion 13 of discharge electrode 1. Counter electrode 4 has opening 43 in a central portion of counter electrode 4. Opening 43 passes through counter electrode 4 in a thickness direction of counter electrode 4. Counter electrode 4 has opening 43 in a region closest to front-end portion 13 of discharge electrode 1. A direction in which opening 43 passes and an axial direction of discharge electrode 1 are parallel with each other. The term "parallel" as used herein encompasses not only "strictly parallel", but also "substantially parallel".

Current path 5 is a current path through which counter electrode 4 is electrically connected to discharge electrode 1, and voltage applicator 2 is disposed in a middle of current path 5. That is, current path 5 includes first current path 51 that electrically connects voltage applicator 2 and counter electrode 4 and second current path 52 that electrically connects voltage applicator 2 and discharge electrode 1.

In the discharge device according to the present exemplary embodiment, a high voltage of approximately 7.0 kV is applied across discharge electrode 1 and counter electrode 4 by voltage applicator 2 while liquid 35 is being held on discharge electrode 1. As a result, discharge occurs between discharge electrode 1 and counter electrode 4.

In the discharge device according to the present exemplary embodiment, first, local corona discharge is generated at front-end portion 13 of discharge electrode 1 (a front end of liquid 35 held on front-end portion 13), and this corona discharge is developed into discharge of higher energy. In this discharge of higher energy, a discharge path is intermittently due to dielectric breakdown (total breakdown) so as to extend from discharge electrode 1 to a surrounding. In the discharge device according to the present exemplary embodiment, a discharge path is generated intermittently (in a pulse manner) by dielectric breakdown so as to connect discharge electrode 1 and counter electrode 4. This form of discharge is referred to as "leader discharge".

Figure 2A:
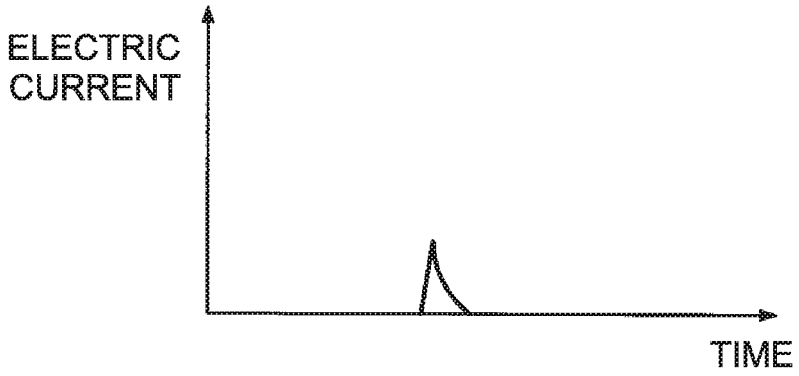
FIG. 2A is a graph schematically illustrating an electric current flowing in corona discharge.
Figure 2B:
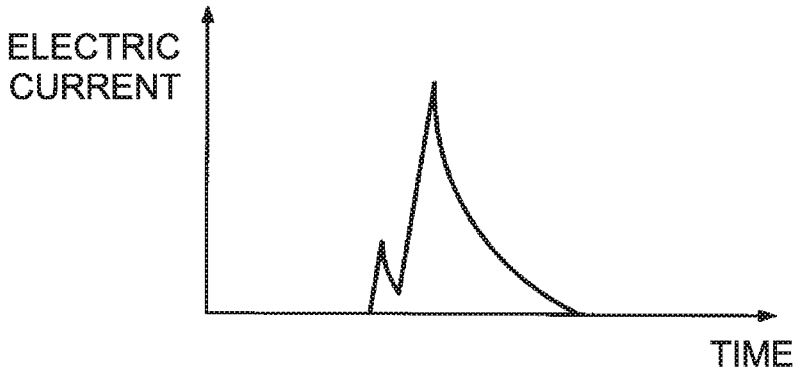
FIG. 2B is a graph schematically illustrating an electric current flowing in leader discharge.

In the leader discharge, an instantaneous electric current that is approximately 2 to 10 times as high as an electric current in the corona discharge flows through the discharge path that is created by dielectric breakdown between discharge electrode 1 and counter electrode 4. FIG. 2A schematically illustrates an electric current flowing due to the corona discharge, and FIG. 2B schematically illustrates an electric current flowing due to the leader discharge developed from the corona discharge. In the leader discharge, radicals are generated by larger energy than the corona discharge, and a large amount of radicals that is approximately two to ten times as large as an amount of radicals generated in the corona discharge is generated.

Ozone is also generated when radicals are generated by the leader discharge. However, an amount of ozone generated in the leader discharge is kept approximately same as an amount of ozone generated in the corona discharge while an amount of radicals generated in the leader discharge is approximately two to ten times as large as an amount of radicals generated in the corona discharge. That is, by developing the corona discharge into the leader discharge, an amount of generated ozone relative to an amount of generated radicals is kept markedly small. This is considered to be because part of generated ozone is broken by the high-energy leader discharge during release of the generated ozone under exposure to the leader discharge.

The leader discharge is described in more detail below.

In general, when discharge is generated by inputting energy between a pair of electrodes, a discharge form develops from corona discharge to glow discharge and then to arc discharge in accordance with an amount of input energy.

The corona discharge is discharge that occurs locally at one electrode and does not involve dielectric breakdown between electrodes. The glow discharge and the arc discharge are discharge that involves dielectric breakdown between the pair of electrodes, and a discharge path created by the dielectric breakdown continuously exists during input of the energy.

Meanwhile, the leader discharge involves dielectric breakdown between the pair of electrodes, but the dielectric breakdown does not continuously occur but intermittently occurs.

In the discharge device according to the present exemplary embodiment, electrical capacitance of voltage applicator 2 (capacitance of electricity that can be discharged per unit time) is set so that leader discharge with this form occurs between discharge electrode 1 and counter electrode 4. That is, in the discharge device according to the present exemplary embodiment, the electrical capacitance of voltage applicator 2 is set so that when the corona discharge develops into dielectric breakdown, a large instantaneous electric current flows through a discharge path created by the dielectric breakdown, but the flow of the large instantaneous electric current is followed by a voltage drop and stoppage of the discharge and subsequent voltage rise and dielectric breakdown that are repeated. By thus setting the capacitance, the leader discharge is achieved in which instantaneous dielectric breakdown and stoppage of discharge are repeated alternately, instead of continuous dielectric breakdown as in the case of glow discharge and arc discharge.

In one example confirmed so far, a discharge frequency (a frequency of an instantaneous electric current) in the leader discharge is approximately 50 Hz to 10 kHz, and a pulse width is approximately 200 ns at most. As described above, the leader discharge is clearly different from the glow discharge and arc discharge in that instantaneous discharge (a high-energy state) and stoppage of discharge (a low-energy state) are repeated alternately.

In the discharge device according to the present exemplary embodiment, liquid 35 is supplied to discharge electrode 1 by liquid supplying unit 3. Accordingly, liquid 35 is electrostatically atomized by the high-energy leader discharge that involves intermittent dielectric breakdown, and thus a nanometer-size charged microp article liquid containing radicals is generated. The generated charged microp article liquid is discharged to an outside through opening 43.

An amount of radicals is larger in the charged microp article liquid generated by the leader discharge than in a charged microparticle liquid generated by corona discharge. Furthermore, an amount of ozone generated by the leader discharge is kept almost same as an amount of ozone generated by corona discharge.

The discharge device according to the present exemplary embodiment described with reference to FIG. 1 and other drawings is a device (an electrostatic atomizing device) that includes liquid supplying unit 3 in order to generate a charged microp article liquid but may be configured not to include liquid supplying unit 3. In this case, air ions are generated by leader discharge occurring between discharge electrode 1 and counter electrode 4.

Furthermore, the discharge device according to the present exemplary embodiment includes counter electrode 4 but may be configured not to include counter electrode 4. In this case, a charged microparticle liquid is generated by leader discharge by causing leader discharge between discharge electrode 1 and some kind of member around discharge electrode 1. The discharge device according to the present exemplary embodiment may be configured to include neither liquid supplying unit 3 nor counter electrode 4. In this case, air ions are generated by leader discharge by causing leader discharge between discharge electrode 1 and some kind of member around discharge electrode 1.

Second Exemplary Embodiment

A discharge device according to a second exemplary embodiment is described below with reference to FIGS. 3A and 3B. Detailed description of constituent elements that are similar to those in the first exemplary embodiment is omitted.

Figure 3A:
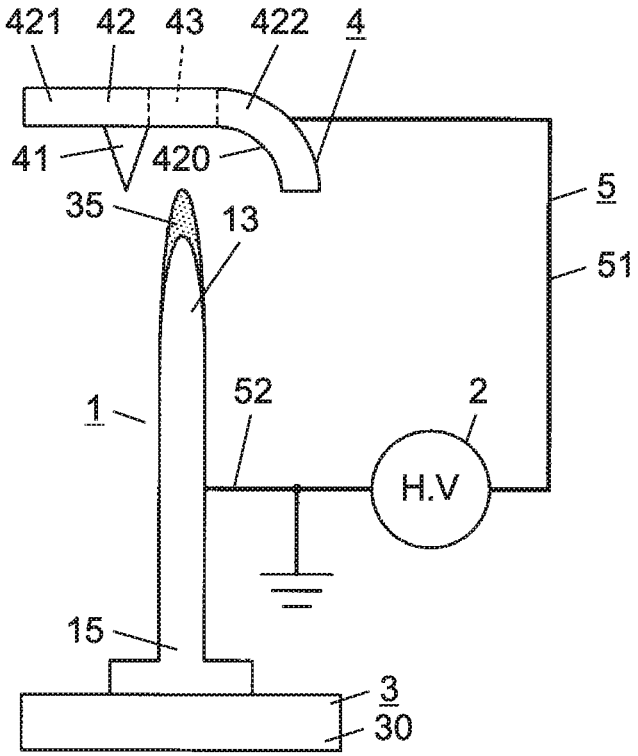
FIG. 3A is a schematic view illustrating a discharge device according to a second exemplary embodiment.

FIG. 3A illustrates a basic configuration of a discharge device according to the present exemplary embodiment. The discharge device according to the present exemplary embodiment is different from the discharge device according to the first exemplary embodiment in that counter electrode 4 includes needle-shaped electrode portion 41 and supporting electrode portion 42 that supports needle-shaped electrode portion 41.

Needle-shaped electrode portion 41 is an electrode portion that protrudes toward discharge electrode 1 from opposing surface 420 of supporting electrode portion 42 that faces discharge electrode 1. Needle-shaped electrode portion 41 has a sharply pointed surface. Of all portions of counter electrode 4, a tip of needle-shaped electrode portion 41 is located closest to discharge electrode 1. Needle-shaped electrode portion 41 is located close to opening 43 of counter electrode 4. The discharge device according to the present exemplary embodiment includes single needle-shaped electrode portion 41 but may include a plurality of needle-shaped electrode portions 41.

Supporting electrode portion 42 is constituted by flat-plate-shaped electrode portion 421 that has a flat opposing surface and dome-shaped electrode portion 422 having a concave opposing surface. The opposing surface of electrode portion 421 and the opposing surface of electrode portion 422 constitute opposing surface 420 of supporting electrode portion 42. Opposing surface 420 of supporting electrode portion 42 has a shape formed by combining a flat surface and a concave surface.

Since the discharge device according to the present exemplary embodiment has the above configuration, electric field concentration occurs at needle-shaped electrode portion 41 of counter electrode 4 and front-end portion 13 of discharge electrode 1 (i.e., a front end of liquid 35 held on front-end portion 13), and leader discharge caused by dielectric breakdown stably occurs between needle-shaped electrode portion 41 of counter electrode 4 and front-end portion 13 of discharge electrode 1. In addition, opposing surface 420 of supporting electrode portion 42 further increases the electric field concentration at front-end portion 13 of discharge electrode 1.

Figure 3B:
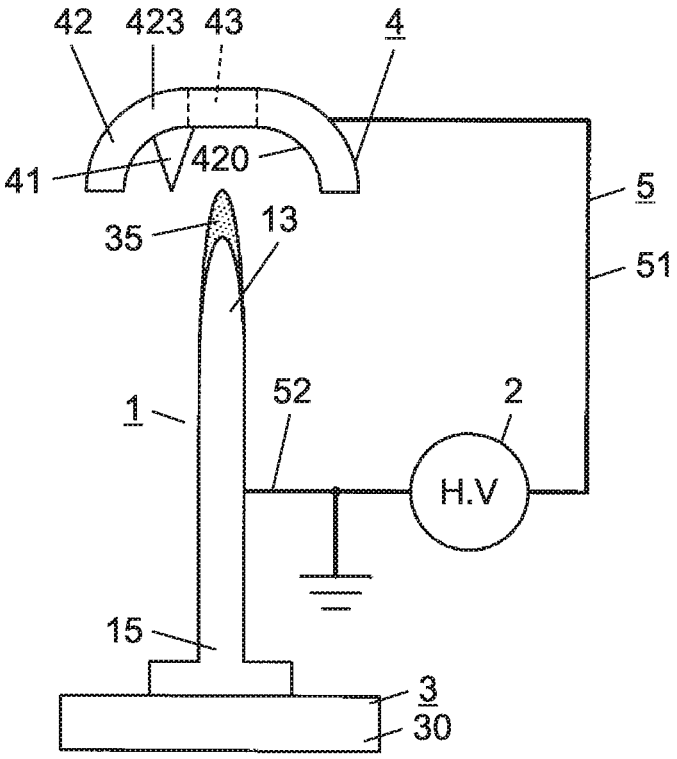
FIG. 3B is a schematic view illustrating a modification of the discharge device.

FIG. 3B illustrates a modification of the discharge device according to the present exemplary embodiment. In this modification, supporting electrode portion 42 is constituted by dome-shaped electrode portion 423 having a concave opposing surface. Opposing surface 420 of supporting electrode portion 42 is a concave surface that is curved in a concave shape around front-end portion 13 of discharge electrode 1.

This modification also produces an advantage of stable occurrence of leader discharge by dielectric breakdown between needle-shaped electrode portion 41 of counter electrode 4 and front-end portion 13 of discharge electrode 1 and an advantage of increased electric field concentration at front-end portion 13 of discharge electrode 1. Opposing surface 420 of supporting electrode portion 42 of counter electrode 4 may have a flat shape, a concave shape, or a combination of a flat shape and a concave shape as appropriate.

Third Exemplary Embodiment

A discharge device according to a third exemplary embodiment is described below with reference to FIGS. 4A and 4B. Detailed description of constituent elements that are similar to those in the first exemplary embodiment is omitted.

Figure 4A:
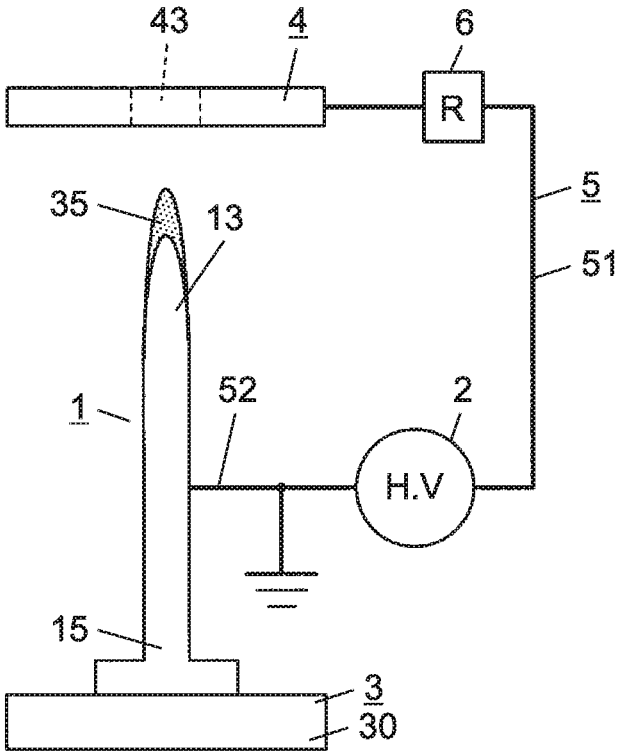
FIG. 4A is a schematic view illustrating a discharge device according to a third exemplary embodiment.

FIG. 4A illustrates the discharge device according to the present exemplary embodiment. The discharge device according to the present exemplary embodiment includes, in a middle of current path 5 for electrically connecting discharge electrode 1 and counter electrode 4, limiting resistor 6 for adjusting an electric current peak of leader discharge. Specifically, limiting resistor 6 is disposed in a middle of first current path 51 that is included in current path 5 and that electrically connects voltage applicator 2 and counter electrode 4.

In leader discharge, an instantaneous electric current flows through a discharge path created by dielectric breakdown, and electric current resistance is very small during flow of the instantaneous electric current. In view of this, the discharge device according to the present exemplary embodiment suppresses an electric current peak of the instantaneous electric current by providing limiting resistor 6 on first current path 51. Suppressing an electric current peak of the instantaneous electric current produces an advantage of suppressing occurrence of NOx and an advantage of preventing influence of electric noise from becoming too large. Limiting resistor 6 is not limited to one using a dedicated element and can have any configuration as long as limiting resistor 6 has preset electric resistance.

Figure 4B:
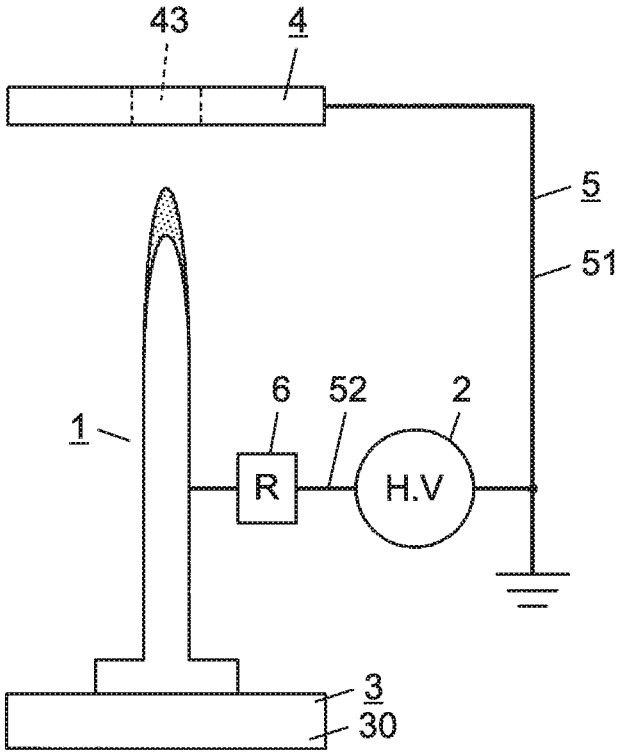
FIG. 4B is a schematic view illustrating a modification of the discharge device.

FIG. 4B illustrates a modification of the discharge device according to the present exemplary embodiment. In this modification, limiting resistor 6 is disposed in a middle of second current path 52 that electrically connects voltage applicator 2 and discharge electrode 1. Also in this modification, a peak value of an instantaneous electric current of leader discharge is suppressed by limiting resistor 6.

Fourth Exemplary Embodiment

Figure 5:
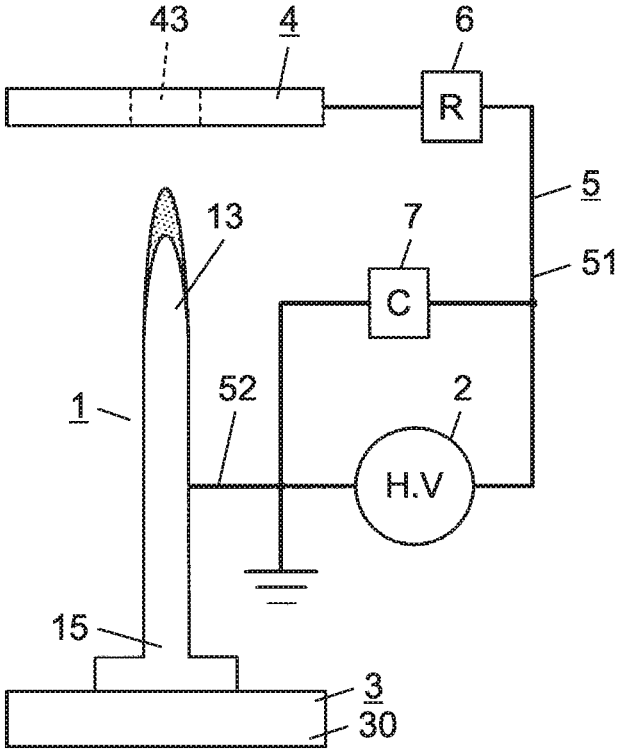
FIG. 5 is a schematic view illustrating a discharge device according to a fourth exemplary embodiment.

A discharge device according to a fourth exemplary embodiment is described below with reference to FIG. 5. Detailed description of constituent elements that are similar to those in the third exemplary embodiment is omitted.

In the discharge device according to the present exemplary embodiment, capacitor 7 that adjusts a discharge frequency of leader discharge is disposed in a middle of current path 5. Capacitor 7 is electrically connected in parallel with voltage applicator 2. Since electric current resistance during flow of an instantaneous electric current is very small in leader discharge as described above, the discharge frequency of the leader discharge is effectively adjusted by disposing capacitor 7 on current path 5.

Capacitor 7 is not limited to one using a dedicated element and can have any configuration as long as capacitor 7 has preset capacitance.

Fifth Exemplary Embodiment

Figure 6A:
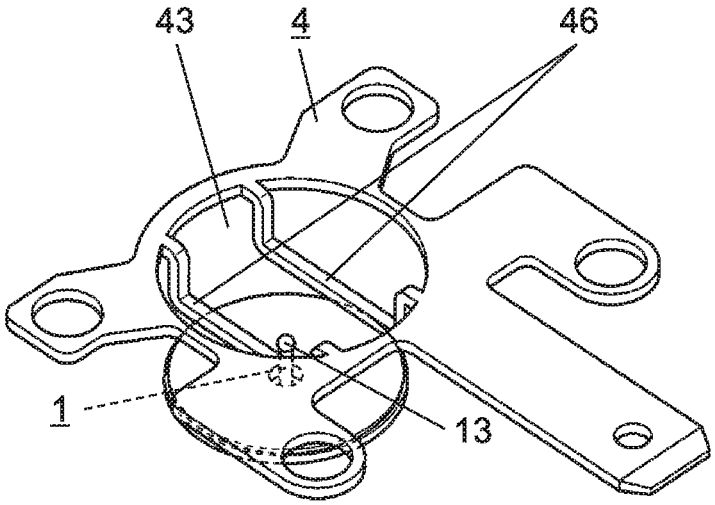
FIG. 6A is a perspective view illustrating a main part of a discharge device according to a fifth exemplary embodiment.

A discharge device according to a fifth exemplary embodiment is described below with reference to FIG. 6A. Detailed description of constituent elements that are similar to those in the second exemplary embodiment is omitted.

In the discharge device according to the present exemplary embodiment, two bar-shaped electrode portions 46 that are parallel with each other are provided so as to be integral with each other instead of needle-shaped electrode portion 41 that has a sharply pointed surface in the second exemplary embodiment in order to stably generate leader discharge involving dielectric breakdown. Counter electrode 4 has circular opening 43. When viewed along an axial direction of discharge electrode 1, two bar-shaped electrode portions 46 are located inside opening 43, and discharge electrode 1 is located between two bar-shaped electrode portions 46. Shortest distances from two bar-shaped electrode portions 46 to front-end portion 13 of discharge electrode 1 are identical to each other. The term "identical" as used herein encompasses not only "strictly identical", but also "substantially identical".

In the discharge device according to the present exemplary embodiment, leader discharge caused by dielectric breakdown can be stably generated between portions, of respective bar-shaped electrode portions 46 of counter electrode 4, that are closest to front-end portion 13 of discharge electrode 1 and front-end portion 13 of discharge electrode 1.

Sixth Exemplary Embodiment

Figure 6B:
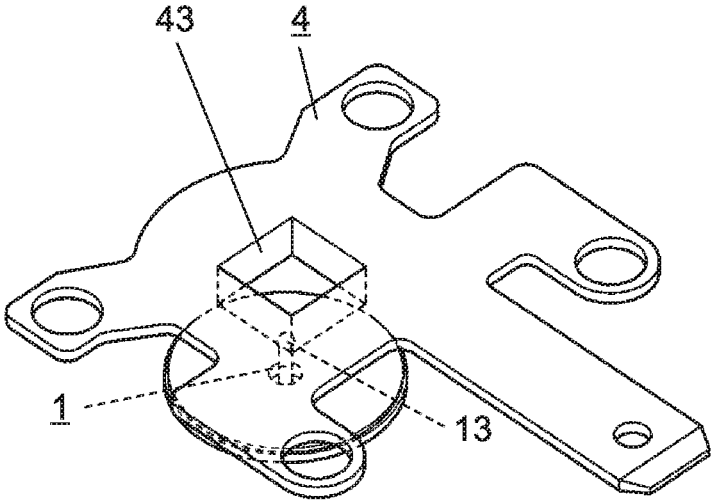
FIG. 6B is a perspective view illustrating a main part of a discharge device according to a sixth exemplary embodiment.

A discharge device according to a sixth exemplary embodiment is described below with reference to FIG. 6B. Detailed description of constituent elements that are similar to those in the second exemplary embodiment is omitted.

In the discharge device according to the present exemplary embodiment, a shape of an opening edge of opening 43 of counter electrode 4 is made polygonal (quadrangular) in order to stably generate leader discharge instead of providing needle-shaped electrode portion 41. Discharge electrode 1 is located at a center of opening 43 when viewed along an axial direction of discharge electrode 1. An inner circumferential surface of opening 43 is made up of a plurality of (four) flat surfaces that are continuous in a circumferential direction. Shortest distances from the flat surfaces to front-end portion 13 of discharge electrode 1 are identical to each other.

In the discharge device according to the present exemplary embodiment, leader discharge can be stably generated between front-end portion 13 of discharge electrode 1 and portions, of the flat surfaces constituting the inner circumferential surface of opening 43, that are closest to front-end portion 13 of discharge electrode 1.

Seventh Exemplary Embodiment

Figure 6C:
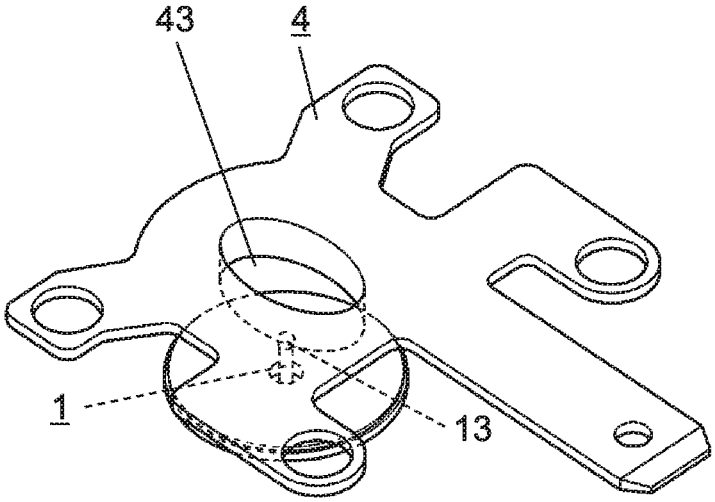
FIG. 6C is a perspective view illustrating a main part of a discharge device according to a seventh exemplary embodiment.

A discharge device according to a seventh exemplary embodiment is described below with reference to FIG. 6C. Detailed description of constituent elements that are similar to those in the second exemplary embodiment is omitted.

In the discharge device according to the present exemplary embodiment, an opening edge of opening 43 of counter electrode 4 is provided so as to have an oval shape in order to stably generate leader discharge instead of providing needle-shaped electrode portion 41. Discharge electrode 1 is located at a center of opening 43 when viewed along an axial direction of discharge electrode 1.

In the discharge device according to the present exemplary embodiment, leader discharge can be stably generated between front-end portion 13 of discharge electrode 1 and two portions, of an inner circumferential surface of opening 43, that are closest to front-end portion 13 of discharge electrode 1.

Eighth Exemplary Embodiment

A discharge device according to an eighth exemplary embodiment is described below with reference to FIGS. 7 to 14. Detailed description of constituent elements that are similar to those in the second exemplary embodiment and the third exemplary embodiment is omitted.

Figure 7:
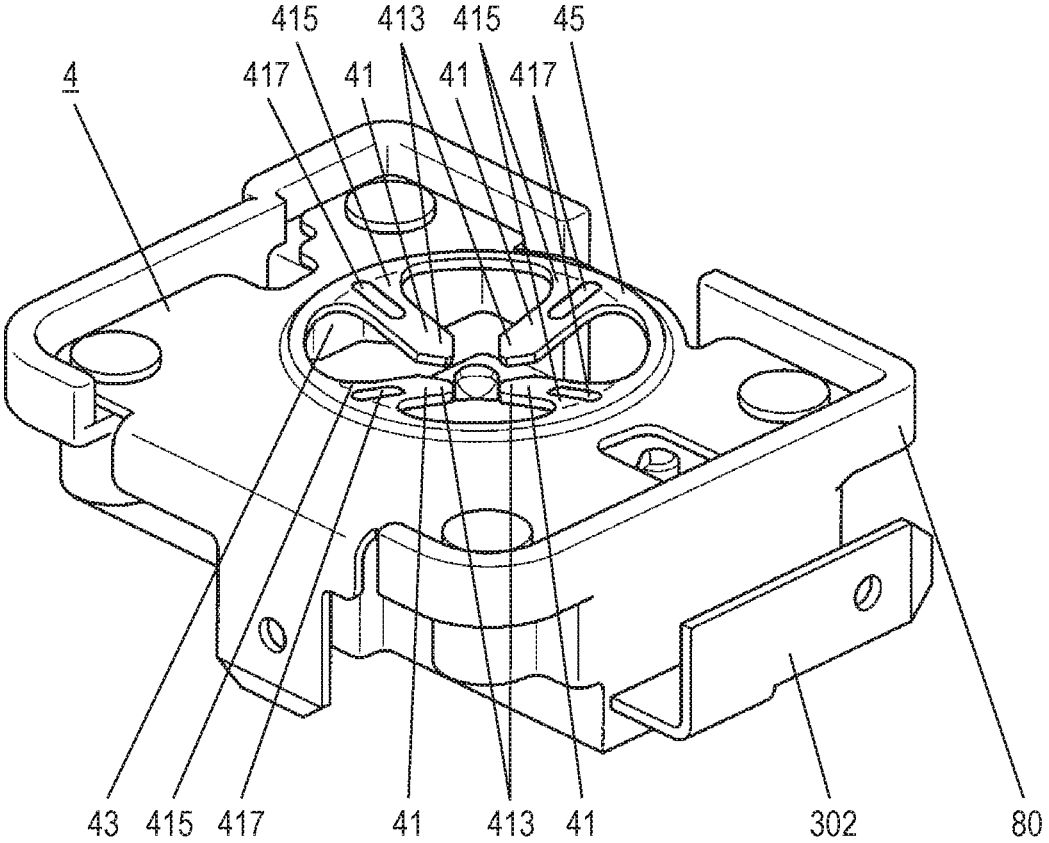
FIG. 7 is a perspective view illustrating a discharge device according to an eighth exemplary embodiment.
Figure 8:
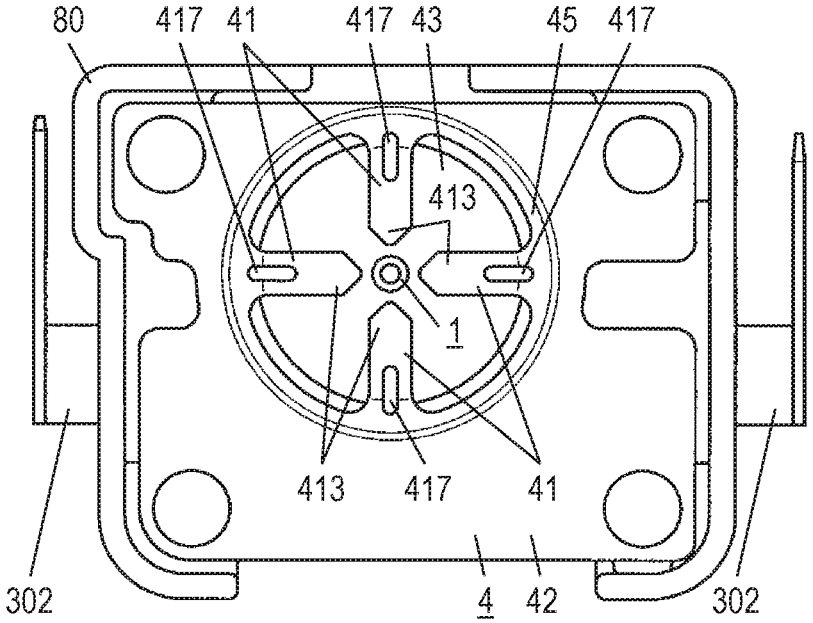
FIG. 8 is a plan view illustrating the discharge device.
Figure 9:
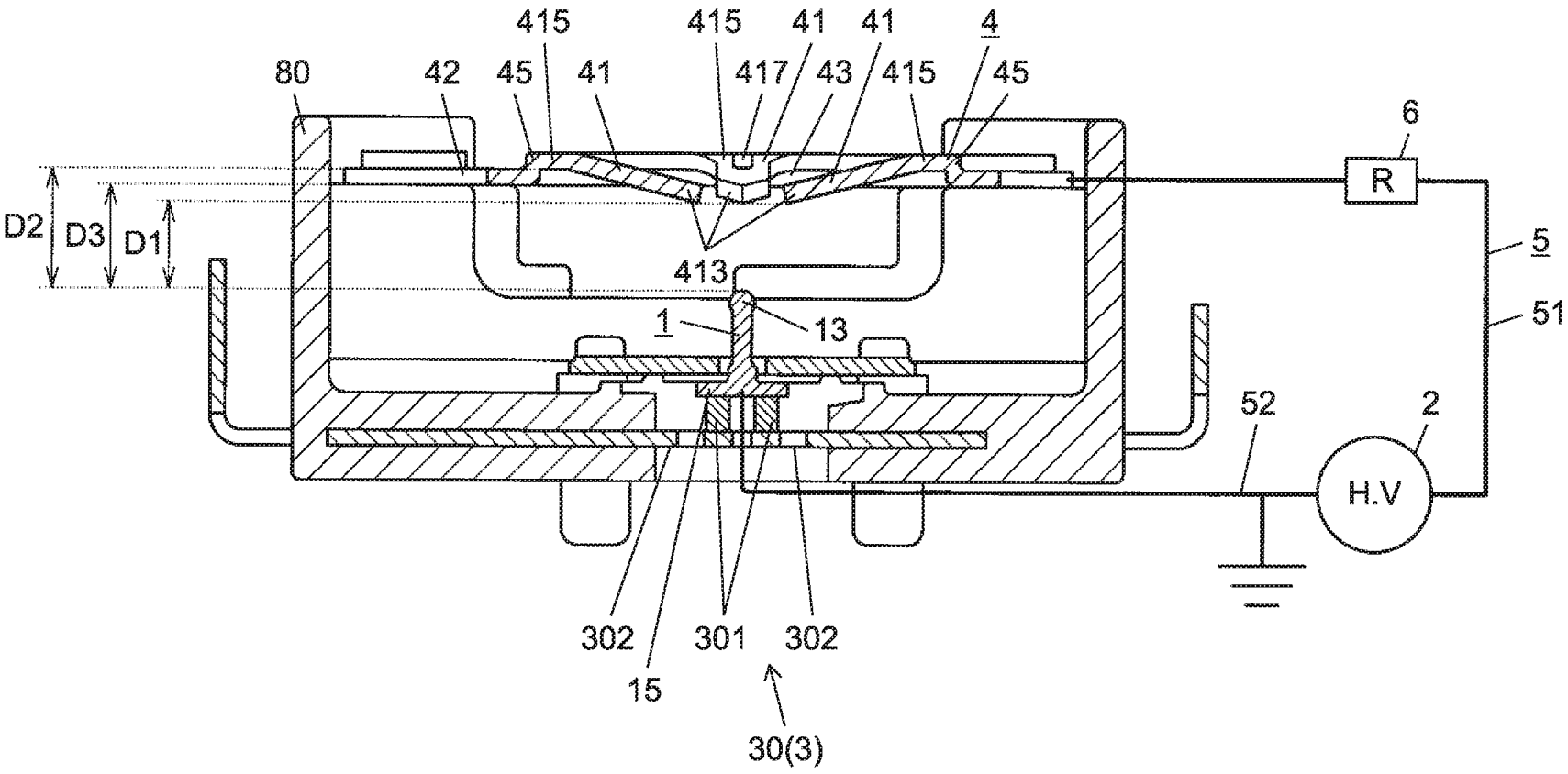
FIG. 9 is a side cross-sectional view illustrating the discharge device.

As illustrated in FIGS. 7 to 9, the discharge device according to the present exemplary embodiment includes discharge electrode 1, voltage applicator 2, liquid supplying unit 3 (cooler 30), counter electrode 4, and current path 5, and further includes limiting resistor 6. Discharge electrode 1 and counter electrode 4 are held at predetermined positions in predetermined postures by housing 80. Limiting resistor 6 is disposed in a middle of first current path 51 that electrically connects voltage applicator 2 and counter electrode 4 similarly to the third exemplary embodiment.

Cooler 30 that constitute liquid supplying unit 3 is a heat exchanger that includes a pair of Peltier elements 301 and a pair of heat radiating plates 302 that are connected to the pair of Peltier elements 301, respectively, and is configured to cool discharge electrode 1 when an electric current is applied to the pair of Peltier elements 301. Each of heat radiating plates 302 has a portion embedded in housing 80 made of a synthetic resin and an exposed portion that includes a portion connected to Peltier elements 301 and that allows heat to be radiated.

A cooling side of each of Peltier elements 301 is mechanically and electrically connected to base-end portion 15 of discharge electrode 1 through solder. A heating side of each of Peltier elements 301 is mechanically and electrically connected to corresponding one of heat radiating plates 302 through solder. The application of an electric current to the pair of Peltier elements 301 is performed through the pair of heat radiating plates 302 and discharge electrode 1.

Counter electrode 4 includes flat-plate-shaped supporting electrode portion 42 that is held in a posture orthogonal to an axial direction of discharge electrode 1 and four needle-shaped electrode portions 41 that are supported by supporting electrode portion 42 so as to be located closer to discharge electrode 1 than supporting electrode portion 42. The term "orthogonal" as used herein encompasses not only "strictly orthogonal", but also "substantially orthogonal".

Each of needle-shaped electrode portions 41 is a long thin strip-shaped electrode portion and has sharply-pointed front-end portion 413 at one end in a longitudinal direction of needle-shaped electrode portion 41 and base-end portion 415 at the other end in the longitudinal direction of needle-shaped electrode portion 41 (on a side opposite to front-end portion 413). Each of needle-shaped electrode portions 41 extends from a circumferential edge of circular opening 43 of counter electrode 4 toward a center of opening 43. Four needle-shaped electrode portions 41 extend toward one another from four portions that are provided on the circumferential edge of circular opening 43 at regular intervals in a circumferential direction. The term "regular intervals" as used herein encompasses not only "strictly regular intervals", but also "substantially regular intervals".

As illustrated in FIG. 8, front-end portions 413 of needle-shaped electrode portions 41 are located on a same circle around discharge electrode 1 at regular intervals in a circumferential direction of the circle when viewed along the axial direction of discharge electrode 1.

As illustrated in FIGS. 7 and 9, each of needle-shaped electrode portions 41 is held so as to be slightly inclined from a posture parallel with supporting electrode portion 42 (a posture orthogonal to the axial direction of discharge electrode 1). Specifically, front-end portion 413 of each of needle-shaped electrode portions 41 is inclined toward discharge electrode 1. Distance D1 between front-end portion 413 and discharge electrode 1 is smaller than distance D2 between base-end portion 415 and discharge electrode 1 in the axial direction of discharge electrode 1.

By thus setting the posture of each of needle-shaped electrode portions 41, electric field concentration more easily occurs at front-end portion 413 of each of needle-shaped electrode portions 41, and as a result leader discharge more stably occurs between front-end portion 413 of each of needle-shaped electrode portions 41 and front-end portion 13 of discharge electrode 1.

Furthermore, counter electrode 4 includes step portion 45 interposed between supporting electrode portion 42 and base-end portions 415 of needle-shaped electrode portions 41. Step portion 45 constitutes the circumferential edge of opening 43. Each of needle-shaped electrode portions 41 extends from step portion 45 toward the center of opening 43. Since step portion 45 is interposed between supporting electrode portion 42 and needle-shaped electrode portions 41, distance D2 between base-end portion 415 and discharge electrode 1 is larger than distance D3 between supporting electrode portion 42 and discharge electrode 1 in the axial direction of discharge electrode 1.

Step portion 45 provided to counter electrode 4 suppresses great protrusion of front-end portion 413 of each of needle-shaped electrode portions 41. This reduces a risk of deformation of needle-shaped electrode portions 41 caused by contact of front-end portions 413 on some kind of surface when counter electrode 4 is placed on this surface during transportation or assembly.

Furthermore, each of needle-shaped electrode portions 41 has external groove 417 that extends from base-end portion 415 toward front-end portion 413. Groove 417 is formed by pushing and bending part of each of needle-shaped electrode portions 41 in a thickness direction of each of needle-shaped electrode portions 41. Each of needle-shaped electrode portions 41 has a higher second moment of area because of groove 417. This makes deformation harder to occur and increases bending strength.

The discharge device according to the present exemplary embodiment described above includes four needle-shaped electrode portions 41 and causes leader discharge through a discharge path intermittently formed by dielectric breakdown between front-end portion 413 of each of needle-shaped electrode portions 41 and front-end portion 13 of discharge electrode 1. The leader discharge occurs in a three-dimensionally wider region between discharge electrode 1 and counter electrode 4 than a case where only single needle-shaped electrode portion 41 is provided. A charged microparticle liquid generated by this leader discharge is efficiently discharged to an outside through opening 43 along a direction of an electric field formed between four needle-shaped electrode portions 41 and discharge electrode 1.

In addition, in the discharge device according to the present exemplary embodiment, front-end portions 413 of respective four needle-shaped electrode portions 41 are located on the same circle at regular intervals in the circumferential direction of the circle. This allows the generated charged microp article liquid to be more efficiently discharged to an outside through opening 43.

A number of needle-shaped electrode portions 41 is not limited to four as long as a plurality of needle-shaped electrode portions 41 are provided. It is, however, preferable that three or more needle-shaped electrode portions 41 be provided in order to efficiently discharge a charged microp article liquid to an outside.

Figure 10A:
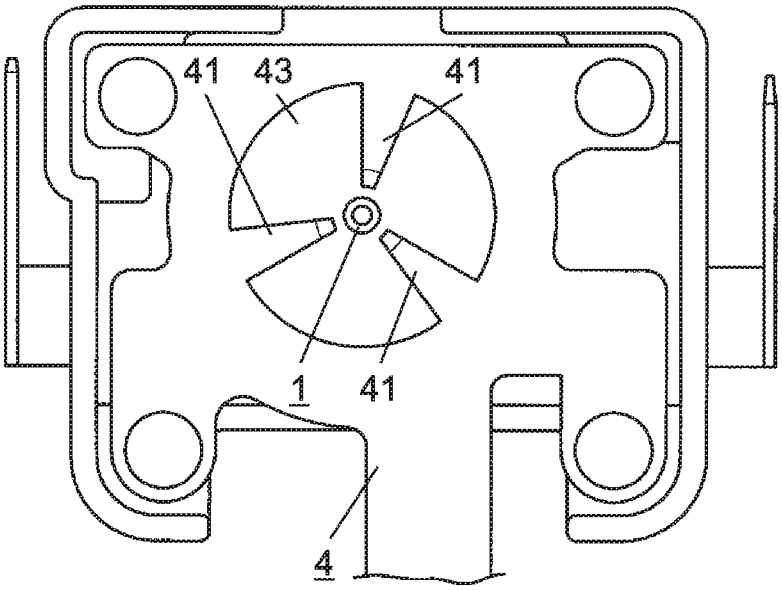
FIG. 10A is a plan view illustrating a modification of the discharge device.
Figure 10B:
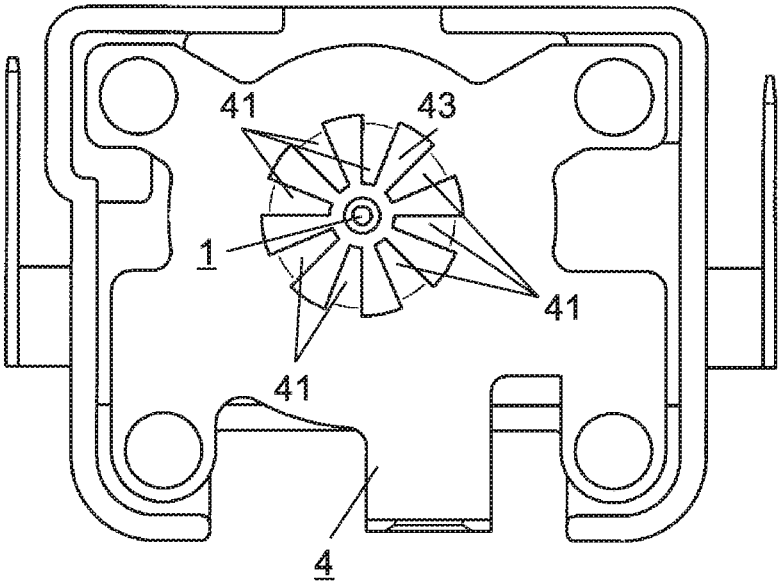
FIG. 10B is a plan view illustrating another modification of the discharge device.

FIGS. 10A and 10B each illustrate a modification. The modification illustrated in FIG. 10A is a modification in which counter electrode 4 includes three needle-shaped electrode portions 41, and the modification illustrated in FIG. 10B is a modification in which counter electrode 4 includes eight needle-shaped electrode portions 41. In these modifications, groove 417 and step portion 45 are omitted.

In counter electrode 4 having three or more needle-shaped electrode portions 41 in opening 43, it is preferable that an opening area of opening 43 be set larger than a total area of three or more needle-shaped electrode portions 41 when viewed along the axial direction of discharge electrode 1. In a case where the opening area is thus set, an electric field is more easily concentrated at front-end portions 413 of needle-shaped electrode portions 41, and leader discharge more stably occurs.

When counter electrode 4 includes a plurality of needle-shaped electrode portions 41 as in the discharge device according to the present exemplary embodiment, it is desirable that front-end portions 413 of respective needle-shaped electrode portions 41 be as uniform as possible in strength of electric field concentration. In a case where a large variation in strength of electric field concentration is caused, a charged microparticle liquid is not efficiently discharged through opening 43.

Figure 11:
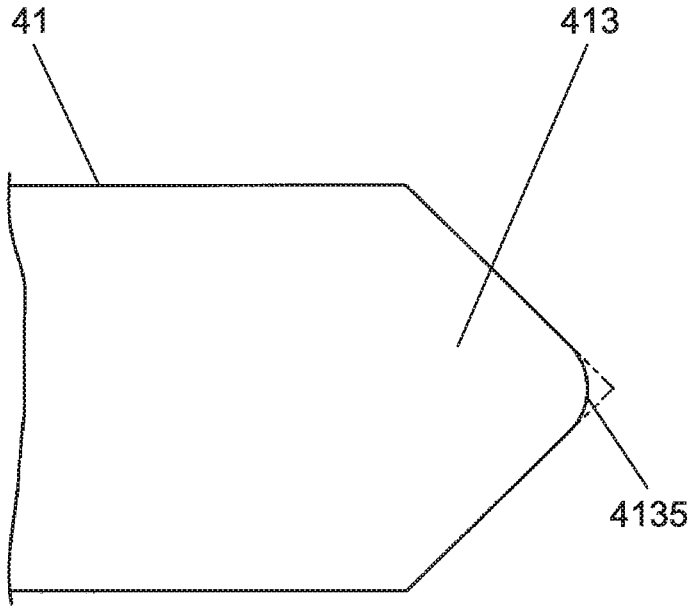
FIG. 11 is a plan view illustrating a main part of another modification of the discharge device.

FIG. 11 illustrates a modification in which tip 4135 of front-end portion 413 of each of needle-shaped electrode portions 41 is rounded. Tip 4135 is a corner portion that is located at a front-most end when each of needle-shaped electrode portions 41 is viewed from a thickness direction of needle-shaped electrode portion 41. In a case where front-end portion 413 of each of needle-shaped electrode portions 41 is rounded, electric field concentration is mitigated to some extent. This prevents a large variation in strength of electric field concentration from being caused by a manufacturing variation during molding of needle-shaped electrode portions 41.

Figure 12A:
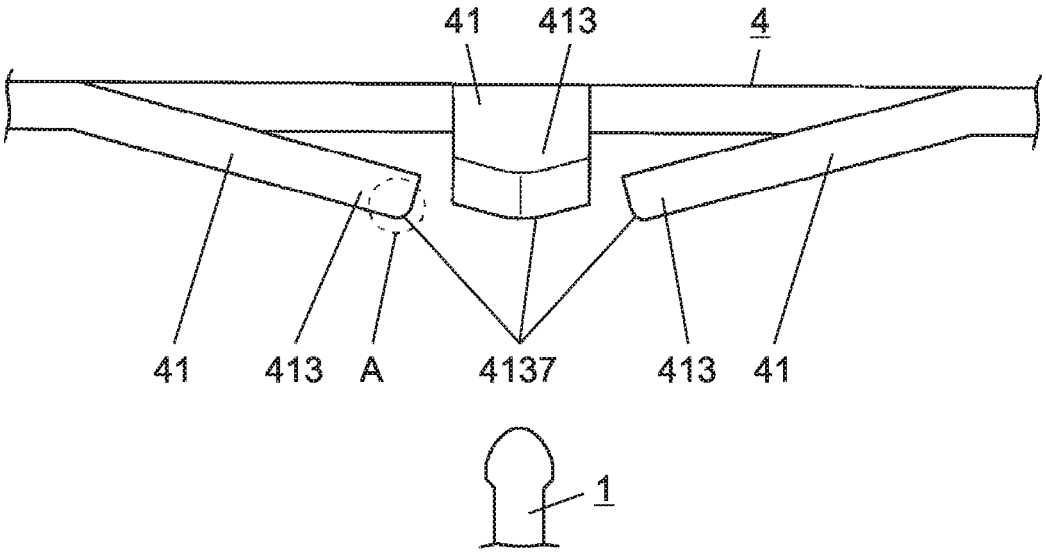
FIG. 12A is a side view illustrating a main part of another modification of the discharge device.
Figure 12B:
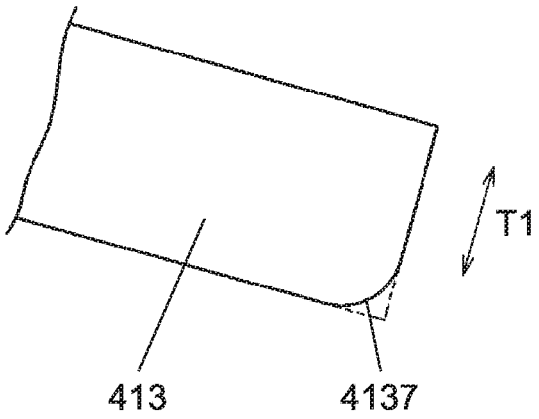
FIG. 12B is an enlarged view of the A portion of FIG. 12A.

FIGS. 12A and 12B each illustrate a modification in which end edge portion 4137 of front-end portion 413 of each of needle-shaped electrode portions 41 is chamfered. End edge portion 4137 is one of end edge portions at both sides in thickness direction T1 (see FIG. 12B) of front-end portion 413 that is closer to discharge electrode 1. Since end edge portion 4137 of each of needle-shaped electrode portions 41 is chamfered, electric field concentration is mitigated to some extent. This prevents a large variation in strength of electric field concentration from being caused by a manufacturing variation during molding of needle-shaped electrode portions 41.

Figure 13:
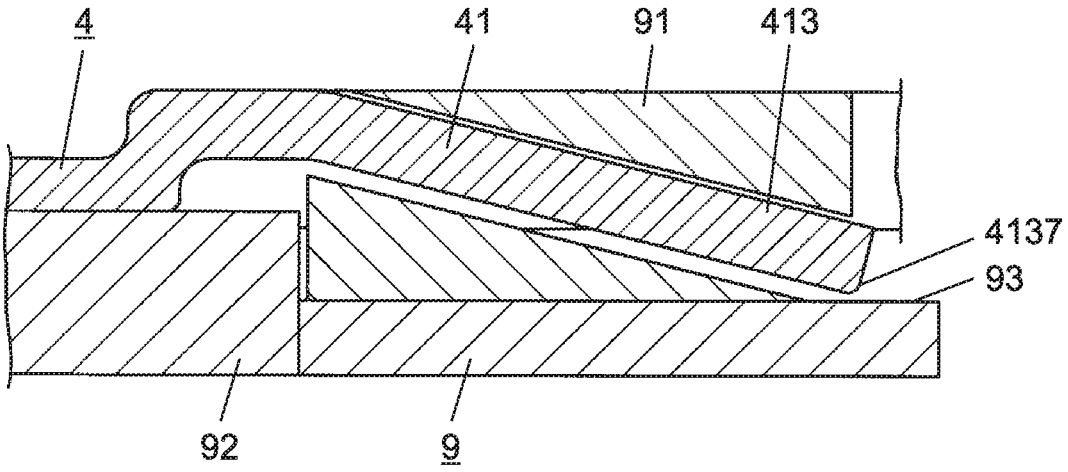
FIG. 13 is a cross-sectional view illustrating a step of molding a needle-shaped electrode portion of the modification illustrated in FIGS. 12A and 12B.

FIG. 13 illustrates a main part of molding device 9 that chamfers end edge portion 4137 of each of needle-shaped electrode portions 41. Molding device 9 includes upper mold 91 and lower mold 92 for bending. When needle-shaped electrode portions 41 are bent between upper mold 91 and lower mold 92, molding device 9 chamfers end edge portions 4137 of needle-shaped electrode portions 41 by causing end edge portions 4137 to be collectively flattened out on a flat surface 93 on lower mold 92 side. According to molding device 9, when needle-shaped electrode portions 41 are bent, end edge portions 4137 can be chamfered concurrently. In addition, positions of front-end portions 413 (positions of end edge portions 4137) of respective needle-shaped electrode portions 41 are made uniform when needle-shaped electrode portions 41 are chamfered. This produces an advantage of making distances from front-end portions 413 of respective needle-shaped electrode portions 41 to discharge electrode 1 uniform.

In these modifications, electric field concentration at front-end portions 413 of respective needle-shaped electrode portions 41 is mitigated, and a variation in strength of electric field concentration is suppressed. However, mitigation of electric field concentration tends to inhibit development into leader discharge. However, development into leader discharge is stably promoted since the opening area of opening 43 is set larger than the total area of the plurality of needle-shaped electrode portions 41 as described above.

Figure 14:
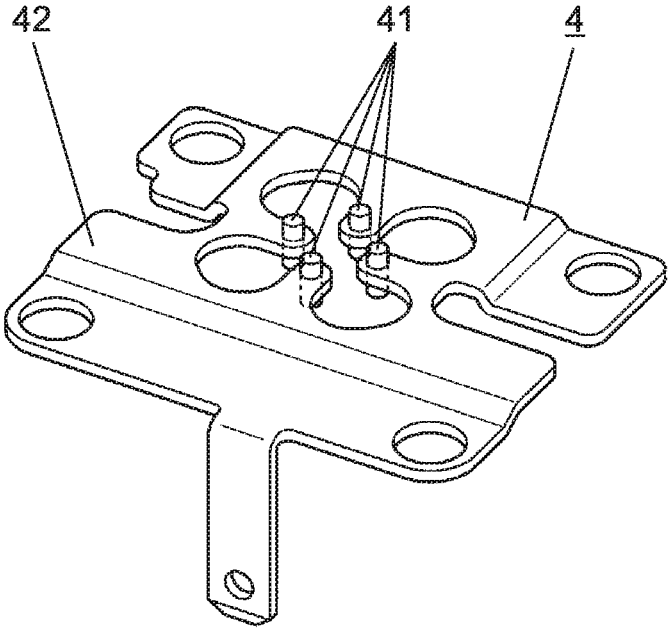
FIG. 14 is a perspective view illustrating a main part of another modification of the discharge device.

FIG. 14 illustrates a modification in which needle-shaped electrode portions 41 and supporting electrode portion 42 of counter electrode 4 are made of different materials. In this modification, needle-shaped electrode portions 41 exposed to leader discharge may be made of a material such as titanium or tungsten that has high resistance to discharge, and supporting electrode portion 42 may be made of a material such as stainless steel which is lower in resistance to discharge than the material of needle-shaped electrode portions 41. This modification has an advantage of increasing resistance of counter electrode 4 to leader discharge with an inexpensive structure.

Ninth Exemplary Embodiment

A discharge device according to a ninth exemplary embodiment is described below with reference to FIGS. 15A to 19. Detailed description of constituent elements that are similar to those in the eighth exemplary embodiment is omitted.

Figure 15A:
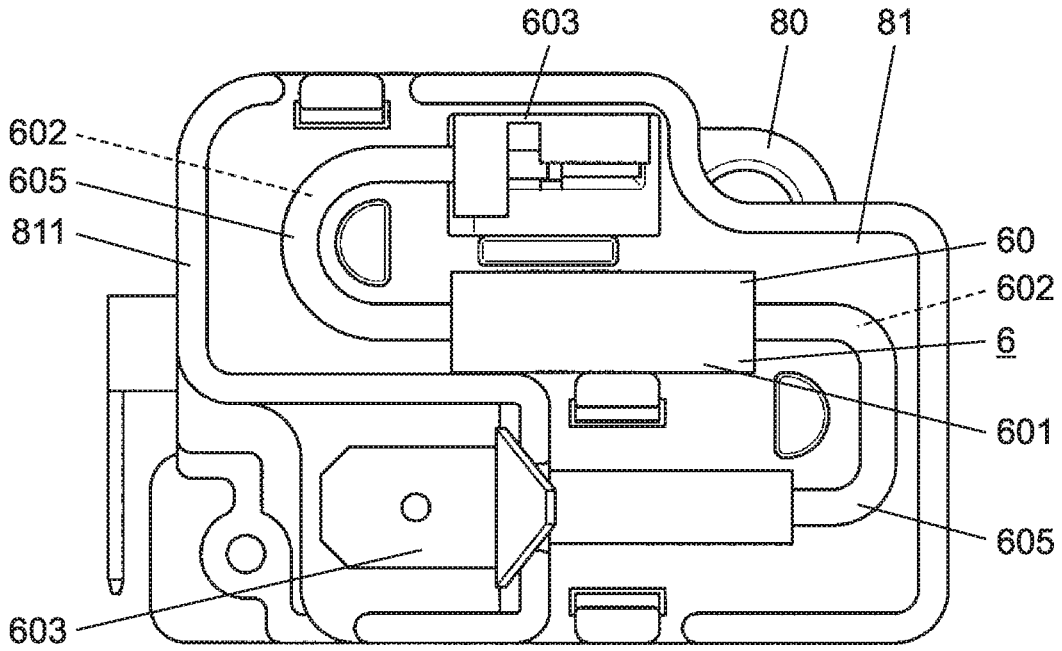
FIG. 15A is a bottom view illustrating a discharge device according to a ninth exemplary embodiment.

As illustrated in FIG. 15A, limiting resistor 6 provided in the discharge device according to the present exemplary embodiment is resistor 60 for high voltage formed by using a dedicated element. Resistor 60 includes resistive element 601, a pair of lead wires 602 that are electrically and mechanically connected to resistive element 601, and terminals 603 that are electrically and mechanically connected to ends of respective lead wires 602. In resistor 60 for high voltage, each of lead wires 602 is typically constituted by a single wire and is vulnerable to bending (vulnerable especially to repeated bending). In view of this, each of lead wires 602 is covered with flexible cover 605 that makes it harder for lead wire 602 to bend. Lead wires 602 that are covered with covers 605 keep a large radius of curvature during bending. This mitigates stress concentration caused by bending.

Figure 15B:
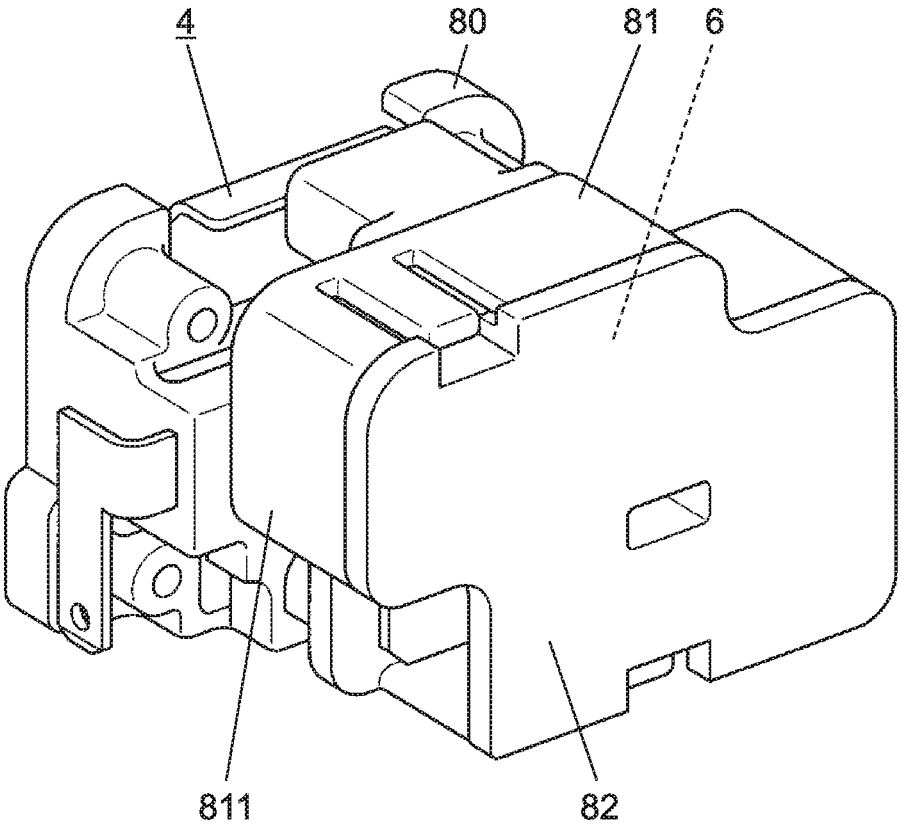
FIG. 15B is a perspective view illustrating a case where the discharge device is provided with a lid.

As illustrated in FIGS. 15A and 15B, the discharge device according to the present exemplary embodiment includes fixing base 81 for fixing resistor 60. Fixing base 81 is integral with housing 80 that supports discharge electrode 1 and counter electrode 4.

Resistive element 601 and terminals 603 are fixed at predetermined positions on fixing base 81. As a result, lead wires 602 are held at predetermined positions of fixing base 81. This suppresses a risk of repeated bending of lead wires 602. Peripheral wall 811 rises from peripheral edge of fixing base 81. Peripheral wall 811 is located so as to surround at least resistive element 601 and the pair of lead wires 602 of resistor 60.

As illustrated in FIG. 15B, lid 82 can be detachably attached to fixing base 81. Resistive element 601 and the pair of lead wires 602 are covered with peripheral wall 811 and lid 82 so as to be untouchable from an outside.

Figure 16:
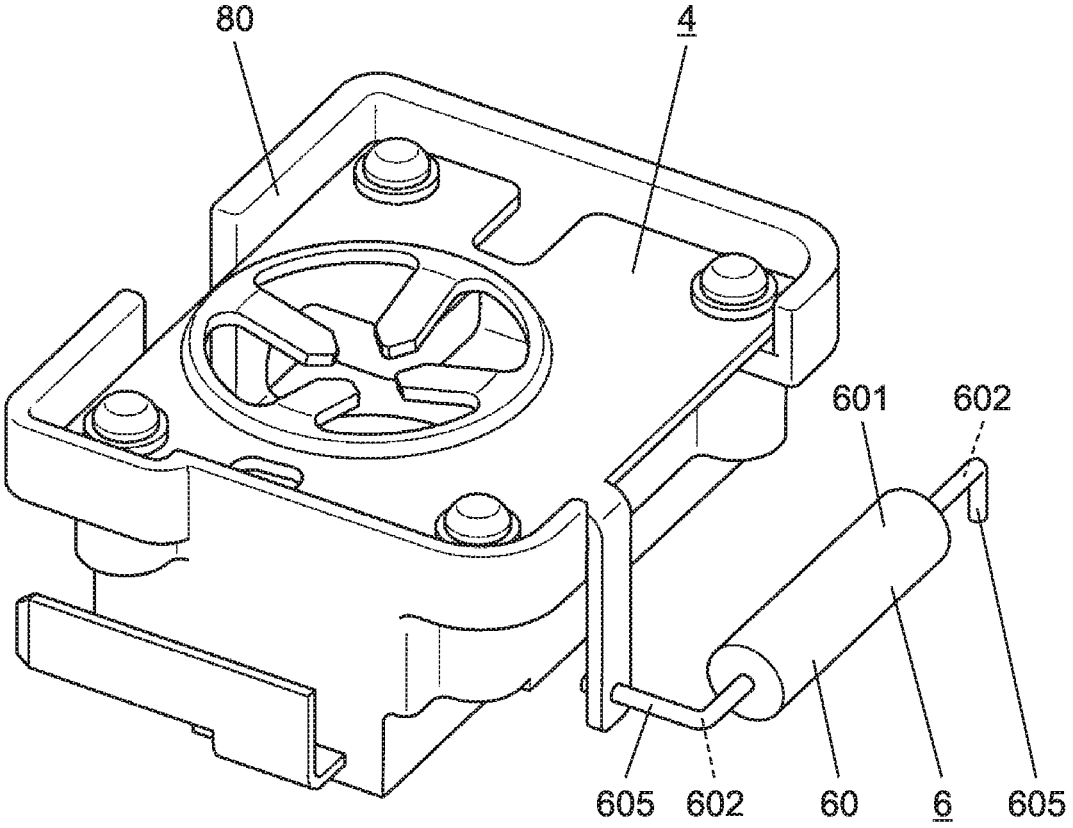
FIG. 16 is a perspective view illustrating a modification of the discharge device.
Figure 17:
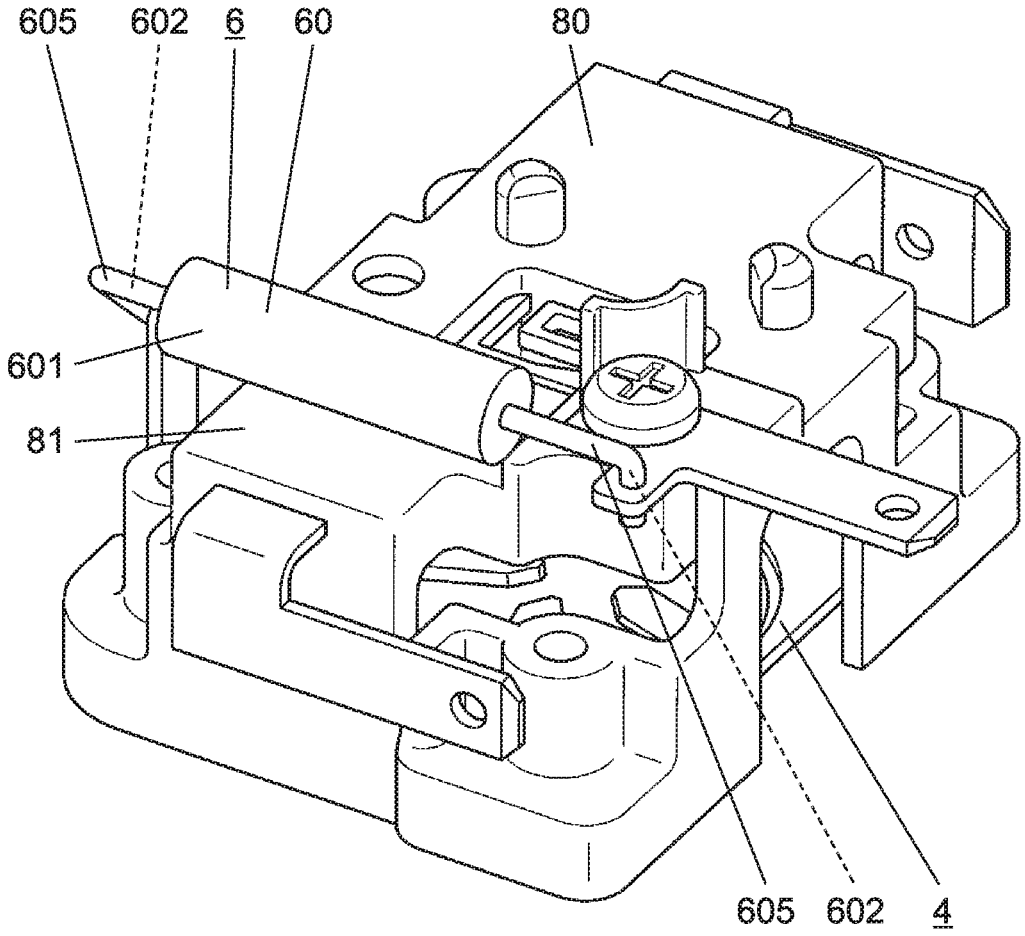
FIG. 17 is a perspective view illustrating another modification of the discharge device.

FIGS. 16 and 17 each illustrate a modification in which resistor 60 is provided without providing fixing base 81 illustrated in FIGS. 15A and 15B. In the modification illustrated in FIG. 16, one lead wire 602 of resistor 60 is directly connected electrically and mechanically to counter electrode 4.

In the modification illustrated in FIG. 17, resistor 60 is directly connected electrically and mechanically to counter electrode 4, and resistor 60 is fixed to an external surface of housing 80. In this modification, a rear surface side of housing 80 (a side opposite to a side where counter electrode 4 is located) serves as fixing base 81.

The modifications illustrated in FIGS. 16 and 17 are examples in which limiting resistor 6 is directly attached to counter electrode 4, in other words, examples in which a length of a wire between counter electrode 4 and limiting resistor 6 is set to 0 mm. When limiting resistor 6 is disposed on first current path 51, the length of the wire between counter electrode 4 and limiting resistor 6 is preferably set within a range from 0 mm to 30 mm. This is because electric current resistance is very small during flow of an instantaneous electric current through a discharge path created by dielectric breakdown and therefore when the length of the wire between counter electrode 4 and limiting resistor 6 is longer than 30 mm, discharge becomes unstable due to influence of floating capacitance of the wire.

Figure 18A:
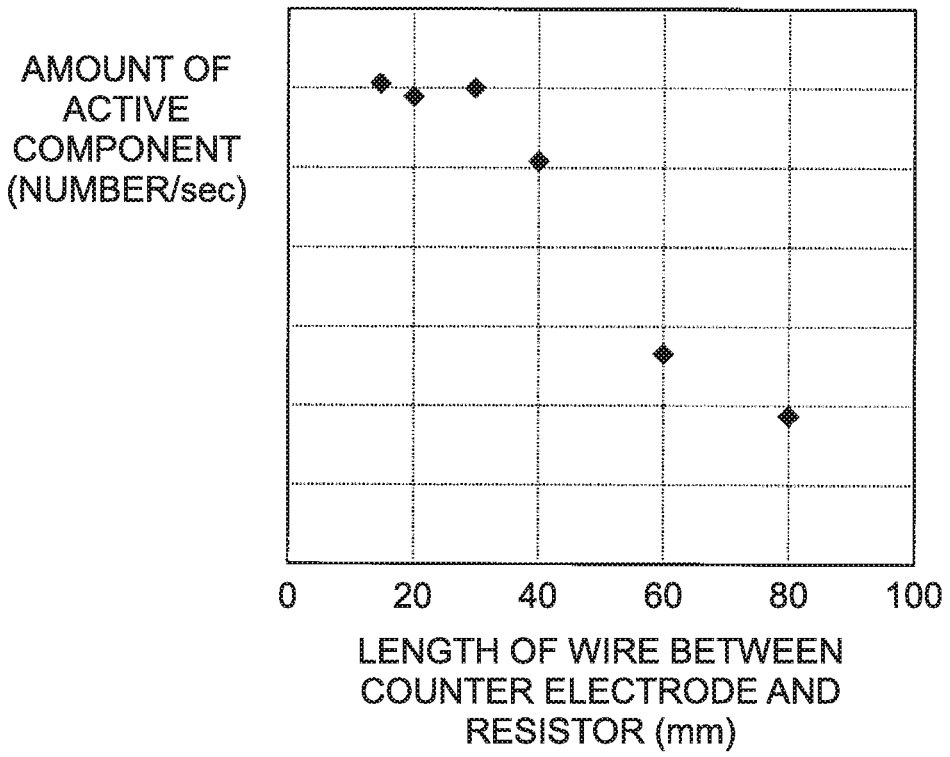
FIG. 18A is a graph illustrating a relationship between a length of a wire between a counter electrode and a resistor and an amount of active component.

It is also confirmed from a measurement result shown in the graph of FIG. 18A that when the length of the wire between counter electrode 4 and limiting resistor 6 is longer than 30 mm, an amount of active component (an amount of radicals) generated by leader discharge decreases. Although no numerical value is shown on the vertical axis of FIG. 18A, an upper limit of the amount of generated radicals is approximately 5 trillion per sec.

In a case where limiting resistor 6 is disposed on first current path 51, a length of a wire between voltage applicator 2 and limiting resistor 6 on first current path 51 is preferably set within a range from 0 mm to 200 mm. This is because electric current resistance is very small during flow of an instantaneous electric current and therefore when the length of the wire between voltage applicator 2 and limiting resistor 6 is longer than 200 mm, discharge becomes unstable due to influence of floating capacitance of the wire.

Figure 18B:
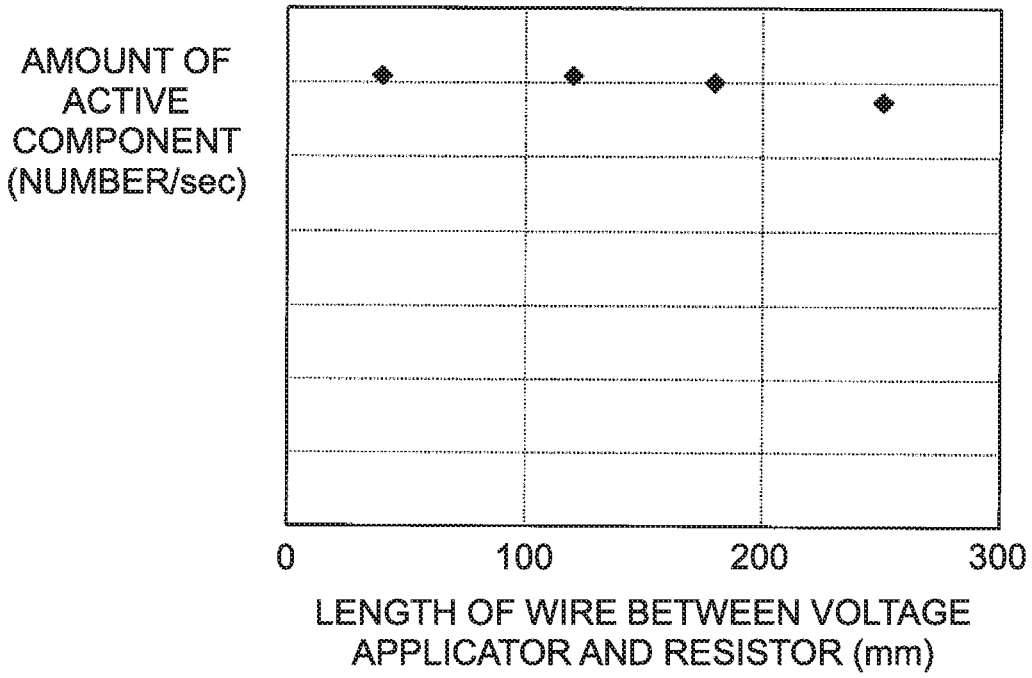
FIG. 18B is a graph illustrating a relationship between a length of a wire between a voltage applicator and a resistor and an amount of active component.

It is also confirmed from a measurement result shown in the graph of FIG. 18B that when the length of the wire between voltage applicator 2 and limiting resistor 6 is longer than 200 mm, an amount of active component (an amount of radicals) generated by leader discharge decreases. Also in FIG. 18B, an upper limit of the amount of generated radicals is approximately 5 trillion per sec.

Figure 19:
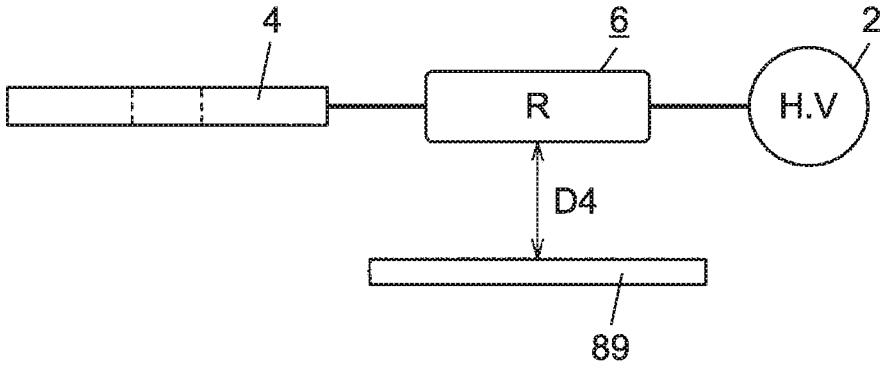
FIG. 19 is a schematic view illustrating a device used for measurement of the graphs of FIGS. 18A and 18B.

The measurement results shown in the graphs of FIGS. 18A and 18B are results measured by using a device schematically illustrated in FIG. 19. In this device, limiting resistor 6 is disposed on a wire that electrically connect counter electrode 4 and voltage applicator 2, and metal plate 89 that serves as ground is disposed at a position away from limiting resistor 6 by distance D4 (=4 mm). An amount of radicals generated by leader discharge was measured by applying a high voltage of 7.0 kV between counter electrode 4 and a discharge electrode (not illustrated).

These results are results obtained when limiting resistor 6 is disposed on first current path 51, but similar results are obtained also when limiting resistor 6 is disposed on second current path 52 that electrically connect discharge electrode 1 and voltage applicator 2 (see FIG. 4B).

That is, when limiting resistor 6 is disposed on second current path 52, a length of a wire between discharge electrode 1 and limiting resistor 6 on second current path 52 is preferably set to 30 mm or less in order to stably cause leader discharge. Furthermore, a length of a wire between voltage applicator 2 and limiting resistor 6 on second current path 52 is preferably set to 200 mm or less in order to stably cause leader discharge.

Tenth Exemplary Embodiment

Figure 21:
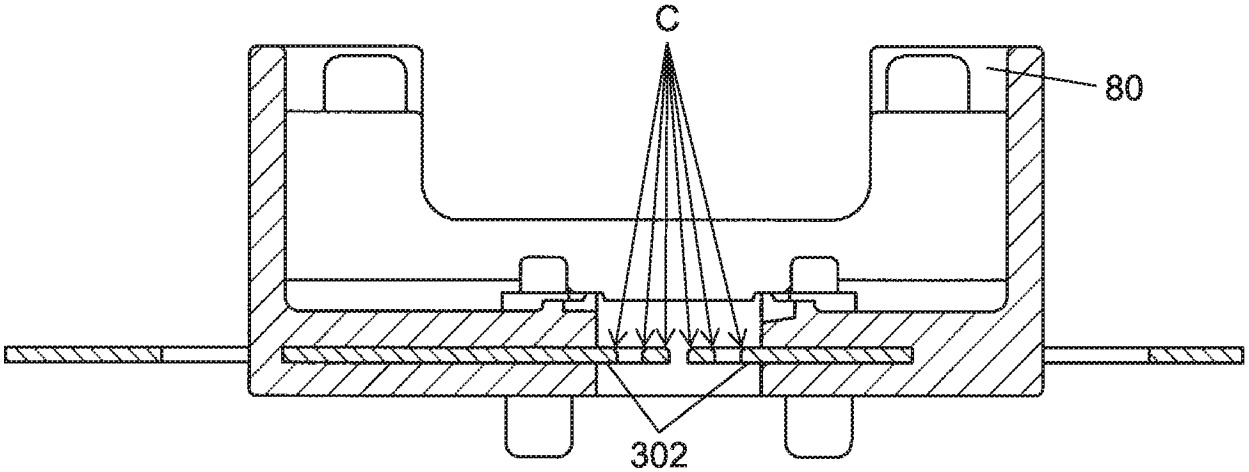
FIG. 21 is a cross-sectional view taken along line 21-21 of FIG. 20.
Figure 22:
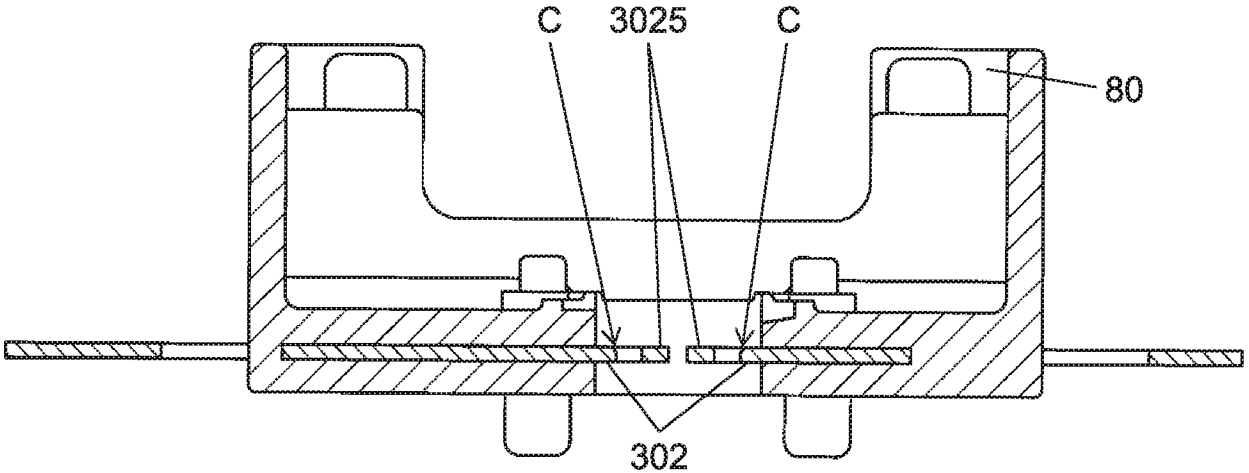
FIG. 22 is a cross-sectional view taken along line 22-22 of FIG. 20.

A discharge device according to a tenth exemplary embodiment is described below with reference to FIGS. 20 to 22. Detailed description of constituent elements that are similar to those in the eighth exemplary embodiment is omitted.

Figure 20:
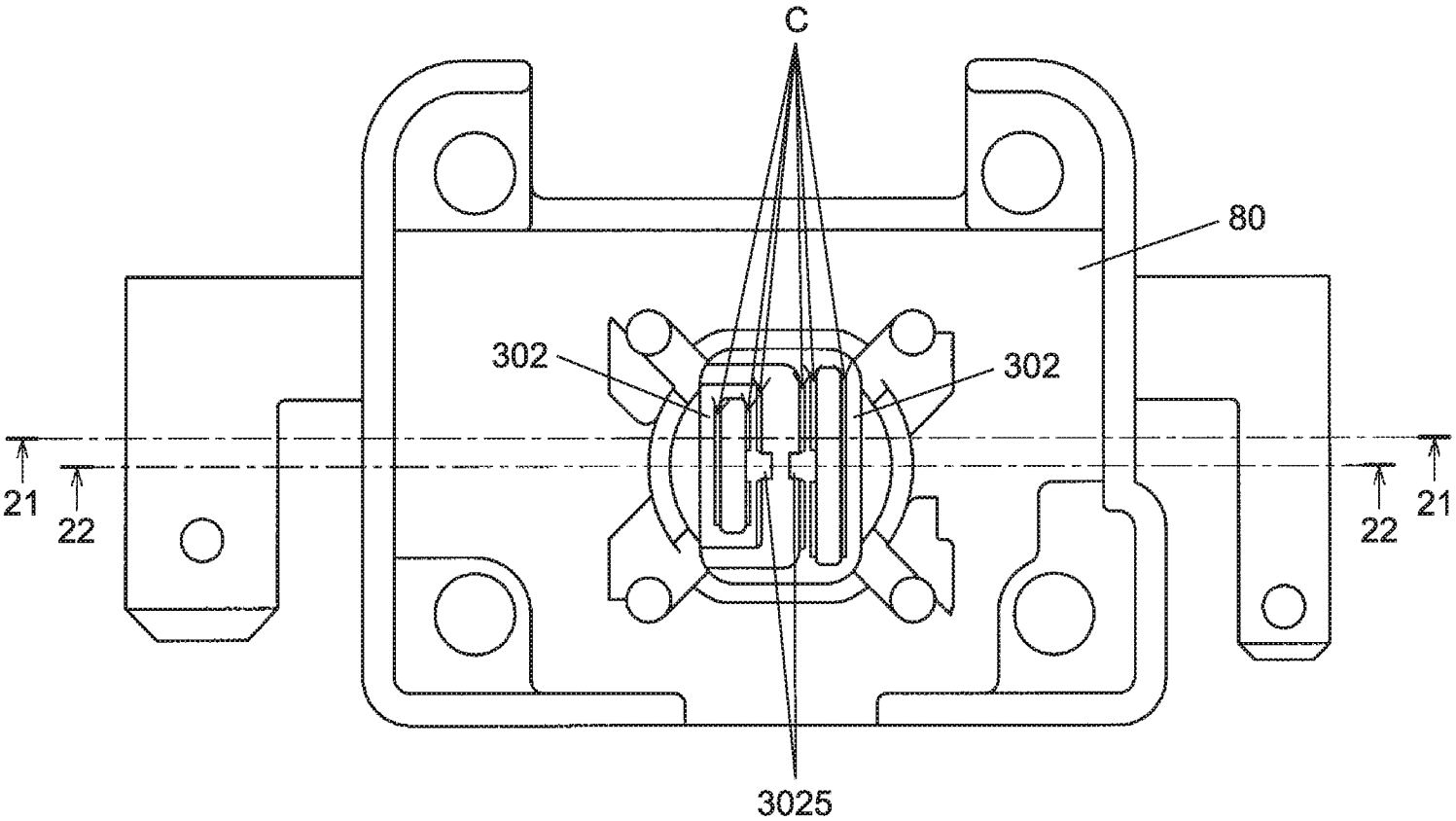
FIG. 20 is a plan view illustrating a main part of a discharge device according to a tenth exemplary embodiment.

FIG. 20 is a plan view illustrating a main part of the discharge device according to the present exemplary embodiment. FIG. 21 is a cross-sectional view taken along line 21-21 of FIG. 20, and FIG. 22 is a cross-sectional view taken along line 22-22 of FIG. 20.

In FIG. 20, discharge electrode 1, counter electrode 4, a pair of Peltier elements 301, and the like are omitted. In the discharge device according to the present exemplary embodiment, corner portions of exposed portions (portions that are not embedded in housing 80) of heat radiating plates 302 are chamfered around portions 3025 where Peltier elements 301 are mounted. Specifically, portions indicated by the arrows C in FIGS. 20 to 22 are chamfered. Stage-shaped portions 3025 on which Peltier elements 301 are mounted are not chamfered.

Heat radiating plates 302 are chamfered in order to securely cover the corner portions of heat radiating plates 302 with a coating when heat radiating plates 302 are coated by being dipped in a coating agent such as a resin (e.g., a urethane ultraviolet curing resin). Heat radiating plates 302 are cut out from a metal plate, and therefore heat radiating plates 302 that has been cut out has, on edges, substantially right-angled corner portions. When heat radiating plates 302 have substantially right-angled corner portions, it is hard to form a sufficiently thick coating on the corner portions. As a result, the corner portions of heat radiating plates 302 are easily exposed.

In the discharge device according to the present exemplary embodiment, leader discharge of higher energy than corona discharge is caused. This tends to increase acidity of liquid 35 (dew condensation water) supplied to discharge electrode 1. Accordingly, in a case where portions of heat radiating plates 302 are exposed from the coating, oxidation (corrosion) occurs from the portions, and durability decreases accordingly.

Another measure against this is to make a thickness of the whole coating large so that the exposure is suppressed. However, since heat radiating plates 302 and whole Peltier elements 301 mounted on heat radiating plates 302 from a cooling side to a heating side are coated, an increase in thickness of the whole coating deteriorates cooling performance of Peltier elements 301. The discharge device according to the present exemplary embodiment makes it possible to suppress deterioration of heat radiating plates 302 and solder while keeping a thickness of a coating small.

Eleventh Exemplary Embodiment

A discharge device according to an eleventh exemplary embodiment is described below with reference to FIGS. 23 and 24. Detailed description of constituent elements that are similar to those in the eighth exemplary embodiment is omitted.

In the discharge device according to present exemplary embodiment, return period controller 85 is disposed on a low-voltage side instead of disposing a capacitor on a high-voltage side as in the discharge device according to the fourth exemplary embodiment in order to adjust a discharge frequency (a frequency of an instantaneous electric current) of leader discharge.

Figure 23:
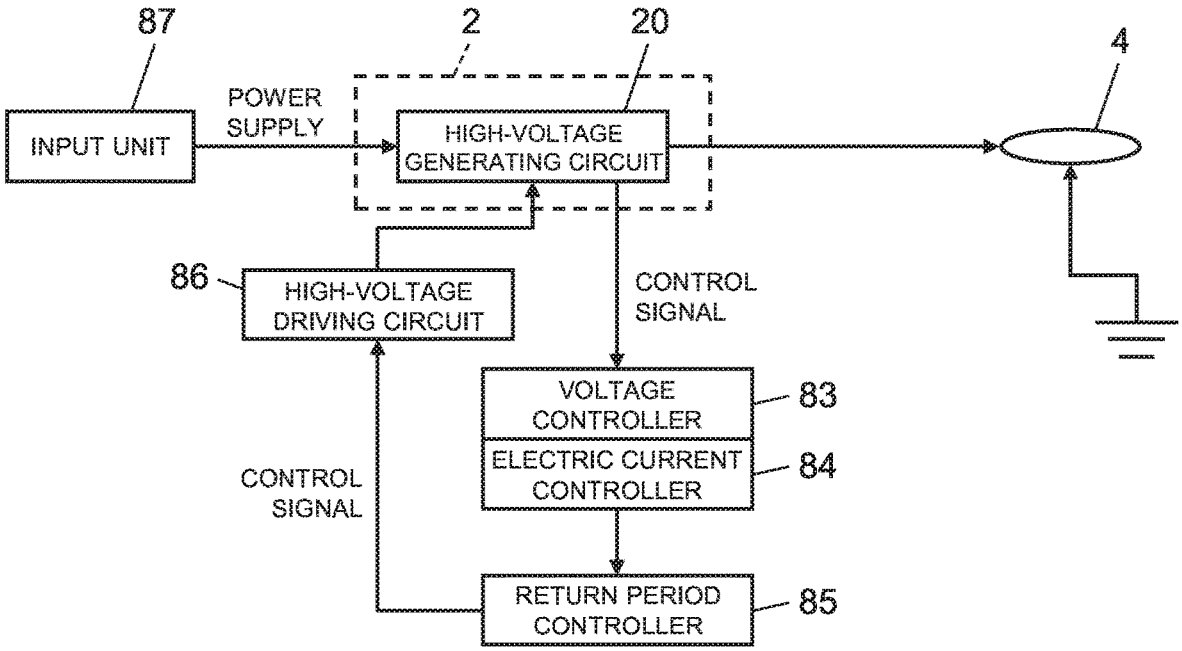
FIG. 23 is a block diagram illustrating a main part of a discharge device according to an eleventh exemplary embodiment.

FIG. 23 is a block diagram illustrating a main part of the discharge device according to the present exemplary embodiment. As illustrated in FIG. 23, the discharge device according to the present exemplary embodiment includes voltage controller 83, electric current controller 84, return period controller 85, high-voltage driving circuit 86, and input unit 87 in addition to high-voltage generating circuit 20 that constitutes voltage applicator 2.

When power is supplied to input unit 87, high-voltage driving circuit 86 operates, and a high voltage is output from high-voltage generating circuit 20. Upon input of a control signal concerning this output to voltage controller 83 and electric current controller 84, voltage controller 83 and electric current controller 84 generate control signals for controlling a voltage and an electric current to predetermined values, respectively, via return period controller 85. Based on the control signal, high-voltage driving circuit 86 increases an output voltage to a predetermined discharge voltage and then repeats the operation for increasing the output voltage to the predetermined discharge voltage when the output voltage decreases due to discharge involving dielectric breakdown. As a result, leader discharge occurs.

In the discharge device according to the present exemplary embodiment, a return period from a decrease in output voltage to recovery to the predetermined discharge voltage can be controlled by return period controller 85. By controlling the return period, the discharge frequency of the leader discharge is adjusted.

Figure 24:
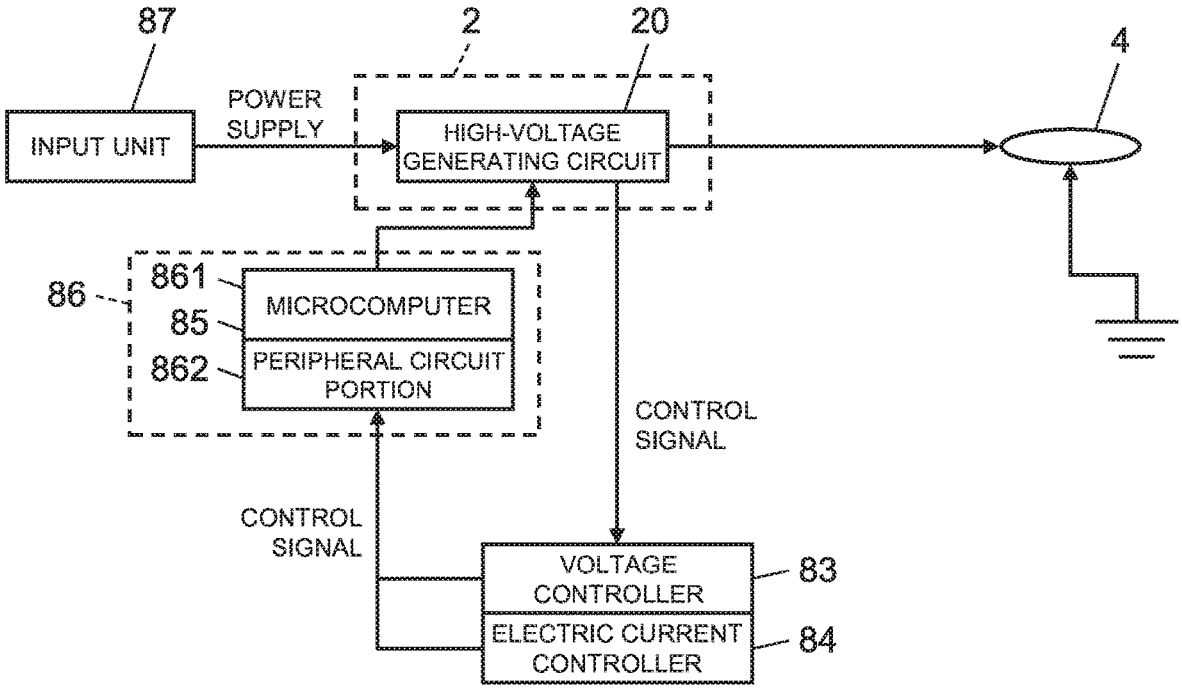
FIG. 24 is a block diagram illustrating a main part of a modification of the discharge device.

FIG. 24 illustrates a modification of the discharge device according to the present exemplary embodiment. In this modification, high-voltage driving circuit 86 includes microcomputer 861 and peripheral circuit portion 862, and return period controller 85 is realized by microcomputer 861. Furthermore, microcomputer 861 may be configured to serve also as at least one of voltage controller 83 and electric current controller 84.

In the discharge device according to the present exemplary embodiment, a discharge frequency of leader discharge can be adjusted by return period controller 85 disposed on a low-voltage side. This produces an advantage of achieving a wider width of adjustment of discharge characteristics and an advantage of keeping an increase in number of members on a high-voltage side small and thereby keeping cost low.

As described above, a discharge device of the present disclosure generates an active component through leader discharge while keeping an increase in ozone small and is therefore applicable to various uses such as a refrigerator, a washing machine, a drier, an air conditioner, an electric fan, an air purifier, a humidifier, a beauty care machine, and an automobile.

What is claimed is:

1. A discharge device comprising:
a discharge electrode; and
a high-voltage generating circuit that constitutes a voltage applicator;
a voltage controller;
an electric current controller;
a return period controller; and
a high-voltage driving circuit that controls the voltage applicator to provide an output voltage, wherein
the voltage applicator is configured to apply the output voltage to the discharge electrode that generates, at the discharge electrode, a high energy discharge that has higher energy than energy of a corona discharge, wherein
the high energy discharge includes a discharge path that is intermittently formed,
the discharge path extends from the discharge electrode into a surrounding due to dielectric breakdown,
based on the high voltage, the high-voltage generating circuit outputs a first control signal to the voltage controller and the electric current controller,
the voltage controller provides a second control signal via the return period controller,
based on the second control signal, the high-voltage driving circuit increases an output voltage to a predetermined discharge voltage and then repeats the operation for increasing the output voltage to the predetermined discharge voltage when the output voltage decreases due to discharge involving dielectric breakdown,
the return period controller controls a return period from a decrease in output voltage to recovery to the predetermined discharge voltage to cause the high energy discharge to have a frequency of 50 Hz to 10 kHz, and
instantaneous discharge and stoppage of discharge are repeated alternately.

2. The discharge device according to claim 1, further comprising
a liquid supplying unit that supplies a liquid to the discharge electrode, wherein the liquid supplied to the discharge electrode is electrostatically atomized by the high energy discharge.

3. The discharge device according to claim 1, further comprising:
a counter electrode that faces the discharge electrode, wherein the discharge path connects the discharge electrode and the counter electrode.

4. The discharge device according to claim 3, wherein the counter electrode includes a needle-shaped electrode portion that faces the discharge electrode.

5. The discharge device according to claim 4, wherein
the needle-shaped electrode portion has a front-end portion and a base-end portion on opposite sides,
the discharge electrode has an axial direction, and
a distance between the front-end portion and the discharge electrode in the axial direction is smaller than a distance between the base-end portion and the discharge electrode in the axial direction.

6. The discharge device according to claim 5, wherein
the counter electrode further includes a supporting electrode portion that is held in a posture orthogonal to the axial direction and a step portion interposed between the supporting electrode portion and the needle-shaped electrode portion, and the distance between the base-end portion and the discharge electrode in the axial direction is larger than a distance between the supporting electrode portion and the discharge electrode in the axial direction.

7. The discharge device according to claim 4, wherein the needle-shaped electrode portion has a groove for reducing deformation of the needle-shaped electrode portion, and the groove is formed by bending a part of the needle-shaped electrode portion in a thickness direction of the needle-shaped electrode portion.

8. The discharge device according to claim 4, wherein the counter electrode further includes a supporting electrode portion that supports the needle-shaped electrode portion, and the needle-shaped electrode portion and the supporting electrode portion are made of different materials.

9. The discharge device according to claim 4, wherein the counter electrode includes a plurality of the needle-shaped electrode portions.

10. The discharge device according to claim 9, wherein front-end portions of each of the needle-shaped electrode portions are located on a circumference of a circle concentric to the discharge electrode.

11. The discharge device according to claim 10, wherein the front-end portions of the respective needle-shaped electrode portions are located at regular intervals from each other along the circumference of the circle.

12. The discharge device according to claim 9, wherein front-end portions of respective needle-shaped electrode portions are rounded.

13. The discharge device according to claim 9, wherein each needle-shaped electrode portion of the plurality of needle-shaped electrode portions is a strip-shaped electrode portion having a thickness defined by two edges of the needle-shaped electrode portion in a thickness direction, and a first edge of the two edges that is closest to the discharge electrode in the thickness direction is chamfered.

14. The discharge device according to claim 9, wherein the plurality of the needle-shaped electrode portions are three or more needle-shaped electrode portions that are located away from one another.

15. The discharge device according to claim 14, wherein the counter electrode further includes an opening in which the three or more needle-shaped electrode portions are disposed, and an opening area of the opening is larger than a total area of the three or more needle-shaped electrode portions.

16. The discharge device according to claim 3, wherein the counter electrode includes a needle-shaped electrode portion and a supporting electrode portion that supports the needle-shaped electrode portion, the needle-shaped electrode portion protruding toward the discharge electrode from an opposing surface of the supporting electrode portion that faces the discharge electrode and having a pointed surface, and the opposing surface has a flat surface shape, a concave surface shape, or a shape formed by combining the flat surface shape and the concave surface shape.

17. The discharge device according to claim 1, further comprising a capacitor that is electrically connected in parallel with the voltage applicator.

18. A method for manufacturing the discharge device according to claim 13, the method comprising crushing all first edges, in the thickness direction, of the plurality of the needle-shaped electrode portions simultaneously on a surface of a molding device to chamfer the first edges.

19. The discharge device according to claim 1, wherein an electric current in the high energy discharge is higher than an electric current in the corona discharge.

20. A discharge device comprising:

a discharge electrode;

a voltage applicator that is configured to apply a voltage to the discharge electrode that generates, at the discharge electrode, a high energy discharge that has higher energy than energy of a corona discharge;

a counter electrode that faces the discharge electrode, wherein the high energy discharge includes a discharge path that is intermittently formed, the discharge path extends from the discharge electrode into a surrounding due to dielectric breakdown, the high energy discharge has a frequency of 50 Hz to 10 kHz, instantaneous discharge and stoppage of discharge are repeated alternately, the discharge path connects the discharge electrode and the counter electrode, the counter electrode includes a needle-shaped electrode portion that faces the discharge electrode, the needle-shaped electrode portion has a front-end portion and a base-end portion on opposite sides, the discharge electrode has an axial direction, a distance between the front-end portion and the discharge electrode in the axial direction is smaller than a distance between the base-end portion and the discharge electrode in the axial direction, the counter electrode further includes a supporting electrode portion that is held in a posture orthogonal to the axial direction and a step portion interposed between the supporting electrode portion and the needle-shaped electrode portion, and the distance between the base-end portion and the discharge electrode in the axial direction is larger than a distance between the supporting electrode portion and the discharge electrode in the axial direction.

21. A discharge device comprising:

a discharge electrode;

a voltage applicator that is configured to apply a voltage to the discharge electrode that generates, at the discharge electrode, a high energy discharge that has higher energy than energy of a corona discharge; and a counter electrode that faces the discharge electrode, wherein the high energy discharge includes a discharge path that is intermittently formed, the discharge path extends from the discharge electrode into a surrounding due to dielectric breakdown, the high energy discharge has a frequency of 50 Hz to 10 kHz, instantaneous discharge and stoppage of discharge are repeated alternately, the discharge path connects the discharge electrode and the counter electrode, the counter electrode includes a needle-shaped electrode portion that faces the discharge electrode, the needle-shaped electrode portion has a groove for reducing deformation of the needle-shaped electrode portion, and the groove is formed by bending a part of the needle-shaped electrode portion in a thickness direction of the needle-shaped electrode portion.

* * * * *